US007318637B2

(12) United States Patent
Ishimoto et al.

(10) Patent No.: US 7,318,637 B2
(45) Date of Patent: Jan. 15, 2008

(54) METHOD FOR DETECTING EJECTION, PRINTING APPARATUS, METHOD FOR FORMING PATTERN FOR DETECTING EJECTION, COMPUTER-READABLE MEDIUM, AND PRINTING SYSTEM

(75) Inventors: Bunji Ishimoto, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 10/899,447

(22) Filed: Jul. 27, 2004

(65) Prior Publication Data

US 2005/0093904 A1 May 5, 2005

(30) Foreign Application Priority Data

Jul. 29, 2003 (JP) ..... 2003-203235

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 5,898,443 A * 4/1999 Yoshino et al. ..... 347/19
5,980,016 A * 11/1999 Nelson et al. ..... 347/19
6,132,024 A * 10/2000 Nelson et al. ..... 347/19
6,454,383 B2 * 9/2002 Lund et al. ..... 347/19
6,572,213 B2 * 6/2003 Valero ..... 347/19
7,052,102 B2 * 5/2006 Valero et al. ..... 347/19
2004/0135837 A1 * 7/2004 Kramer ..... 347/19
2005/0073547 A1 * 4/2005 Endo ..... 347/19
2005/0116978 A1 * 6/2005 Kubota ..... 347/19

FOREIGN PATENT DOCUMENTS

JP 11-240191 A 9/1999

* cited by examiner

*Primary Examiner*—Stephen Meier
*Assistant Examiner*—Rene Garcia, Jr.
(74) *Attorney, Agent, or Firm*—Sughrue Mion, PLLC

(57) ABSTRACT

Ejection of ejecting sections such as nozzles for ejecting clear ink is inspected with ease. A color ink is made to adhere to a medium, a clear ink is ejected toward the medium from each of the clear-ink nozzles, and test patterns that each corresponds to one of the clear-ink nozzles are formed on the medium using the clear ink ejected from each of the clear-ink nozzles and the color ink, while leaving a space between the test patterns.

16 Claims, 21 Drawing Sheets

FIG. 7A
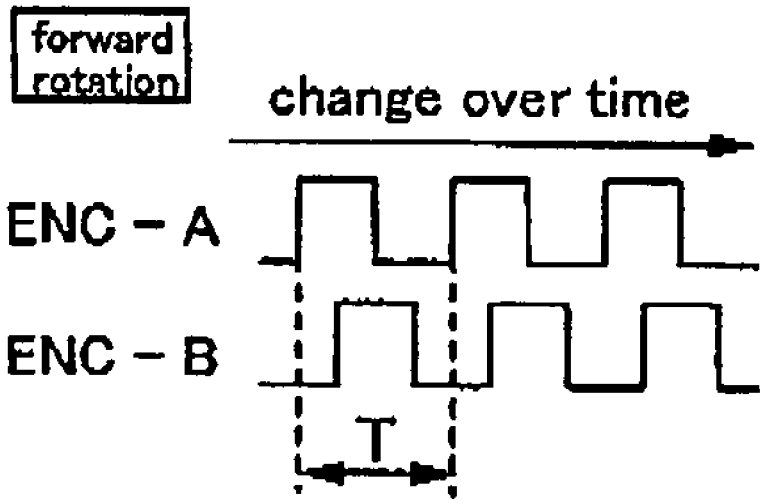
FIG. 7B
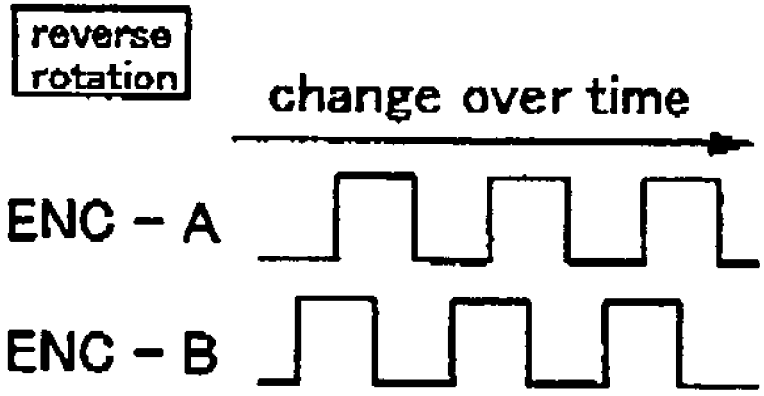
FIG. 7

| | threshold value V1 | threshold value V2 |
|---|---|---|
| cyan (C) | $V1_C$ | $V2_C$ |
| magenta (M) | $V1_M$ | $V2_M$ |
| black (Bk) | $V1_{Bk}$ | $V2_{Bk}$ |
| light cyan (LC) | $V1_{LC}$ | $V2_{LC}$ |
| light magenta (LM) | $V1_{LM}$ | $V2_{LM}$ |
| dark yellow (DY) | $V1_{DY}$ | $V2_{DY}$ |

METHOD FOR DETECTING EJECTION, PRINTING APPARATUS, METHOD FOR FORMING PATTERN FOR DETECTING EJECTION, COMPUTER-READABLE MEDIUM, AND PRINTING SYSTEM

CROSS-REFERENCE TO RELATED APPLICATION

The present application claims priority upon Japanese Patent Application No. 2003-203235 filed on Jul. 29, 2003, which is herein incorporated by reference.

BACKGROUND OF THE INVENTION

1. Field of the Invention

The present invention relates to methods for detecting ejection, printing apparatuses, methods for forming patterns for detecting ejection, computer-readable media, and printing systems.

2. Description of the Related Art

Inkjet printers are known as a type of printing apparatus that carries out printing by ejecting ink onto various media such as paper, cloth, and film. These inkjet printers perform color printing by ejecting color inks such as cyan (C), magenta (M), yellow (Y), and black (K) to form dots on the medium. Ink ejection is normally carried out using nozzles.

However, depending on such factors as firm fixing of the ink, a nozzle may sometimes become clogged and ink may not be properly ejected. When ink is not properly ejected from the nozzles, dots cannot be formed on the medium, and it is not possible to form a proper image. Therefore, it is necessary to inspect whether or not ink is being ejected properly by periodically inspecting nozzle ejection in order to find such nozzle ejection failure.

For this reason, it has conventionally been proposed that in serial-type printers such as inkjet printers, tests on whether or not there are defective dots are to be performed by actually carrying out printing on a recording paper (see JP 11-240191A). In this case, an image sensor is provided in the printer, and this image sensor is used to check whether or not there are defective dots by detecting the state of the printing. When there is a defective dot, the position of the defective dot is stored, and this dot is complemented during printing by using another nozzle, for example.

In recent years, printing apparatuses have been introduced in which a colorless transparent liquid called "clear ink" is ejected in addition to the color inks such as cyan (C), magenta (M), yellow (Y), and black (K). The clear ink ejected in such cases is a liquid that is ejected for the purpose of, for example, improving the quality of the printed image, and specifically, it plays: (1) the role of causing the ink to coagulate and promote fixation, (2) the role of improving the level of gloss, and (3) the role of forming a protective layer on the surface of the medium.

However, since such clear ink is colorless and transparent, it cannot be easily detected by a sensor or the like when ejected onto the medium, and for this reason, it is not possible to easily inspect ejection even when such ink is actually ejected onto the medium.

SUMMARY OF THE INVENTION

The present invention was arrived at in light of the foregoing matters, and it is an object thereof to allow easy inspection of ejection of an ejecting section such as a nozzle that ejects clear ink.

An aspect of the present invention is a method for detecting ejection of a plurality of clear-ink nozzles, comprising the steps of:

causing a color ink to adhere to a medium;

ejecting a clear ink toward the medium from each of the clear-ink nozzles;

forming on the medium test patterns that each corresponds to one of the clear-ink nozzles using the clear ink ejected from each of the clear-ink nozzles and the color ink, while leaving a space between the test patterns; and inspecting ejection of each of the clear-ink nozzles based on the test patterns formed corresponding to the respective clear-ink nozzles.

Another aspect of the present invention is a printing apparatus comprising:

a color-ink nozzle for ejecting a color ink;

a plurality of clear-ink nozzles for ejecting a clear ink; and a controller for controlling the ejection of ink from the color-ink nozzle and the clear-ink nozzles;

wherein the controller controls the ejection of the color ink from the color-ink nozzle and the ejection of the clear ink from the clear-ink nozzles, to form on the medium test patterns that each corresponds to one of the clear-ink nozzles and that each includes the clear ink ejected from each of the clear-ink nozzles and the color ink, while leaving a space between the test patterns.

Another aspect of the present invention is a method for forming patterns for detecting ejection of a plurality of clear-ink nozzles, comprising the steps of:

causing a color ink to adhere to a medium;

ejecting a clear ink toward the medium from each of the clear-ink nozzles; and forming on the medium test patterns that each corresponds to one of the clear-ink nozzles using the clear ink ejected from each of the clear-ink nozzles and the color ink, while leaving a space between the test patterns.

Another aspect of the present invention is a computer-readable medium, comprising:

a code for causing a color ink to adhere to a medium;

a code for causing a clear ink to be ejected toward the medium from each of a plurality of clear-ink nozzles; and a code for causing test patterns that each corresponds to one of the clear-ink nozzles to be formed on the medium using the clear ink ejected from each of the clear-ink nozzles and the color ink, while leaving a space between the test patterns.

Another aspect of the present invention is a printing system comprising:

a computer; and a printing apparatus that is connectable to the computer, the printing apparatus including:

a color-ink nozzle for ejecting a color ink;

a plurality of clear-ink nozzles for ejecting a clear ink; and a controller for controlling the ejection of ink from the color-ink nozzle and the clear-ink nozzles;

wherein the controller controls the ejection of the color ink from the color-ink nozzle and the ejection of the clear ink from the clear-ink nozzles, to form on the medium test patterns that each corresponds to one of the clear-ink nozzles and that each includes the clear ink ejected from each of the clear-ink nozzles and the color ink, while leaving a space between the test patterns.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 7A is a timing chart showing the waveforms of two output signals of the linear encoder 51 when the carriage motor 42 is rotating forward.

FIG. 7B is a timing chart showing the waveforms of two output signals of the linear encoder 51 when the carriage motor 42 is rotating in reverse.

DETAILED DESCRIPTION OF PREFERRED EMBODIMENTS

Figure 1:
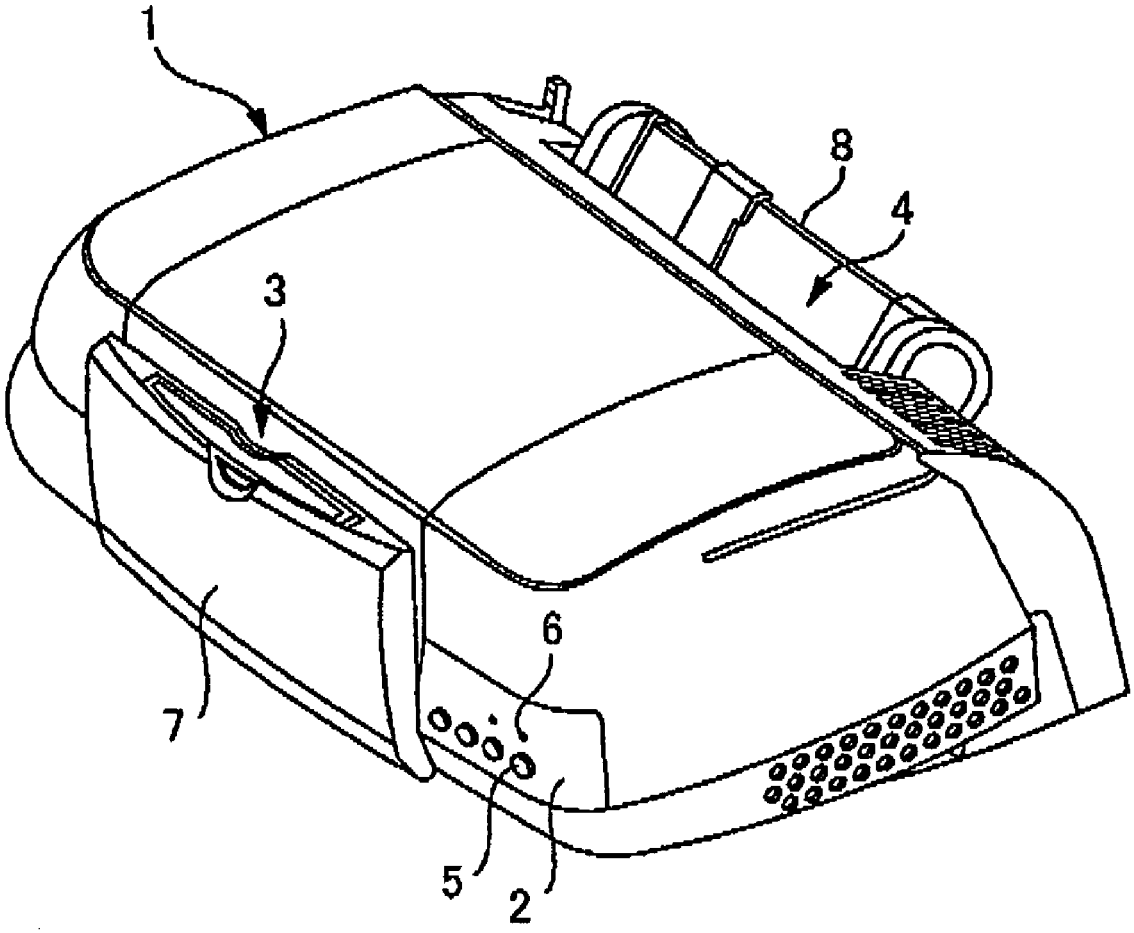
FIG. 1 is a perspective view of an inkjet printer.

At least the following matters will become clear by the explanation in the present specification and the description of the accompanying drawings.

A method for detecting ejection of a plurality of clear-ink nozzles, comprises the steps of:

causing a color ink to adhere to a medium;

ejecting a clear ink toward the medium from each of the clear-ink nozzles;

forming on the medium test patterns that each corresponds to one of the clear-ink nozzles using the clear ink ejected from each of the clear-ink nozzles and the color ink, while leaving a space between the test patterns; and inspecting ejection of each of the clear-ink nozzles based on the test patterns formed corresponding to the respective clear-ink nozzles.

With this method for detecting ejection, a test pattern for each of the clear-ink nozzles is formed on the medium using clear ink and color ink, and thus it is possible to easily confirm whether or not the clear ink is being ejected properly. Moreover, because each clear-ink test pattern is formed with a space between them, warping of the medium can be inhibited compared to a case where the test patterns are formed very close to one another. Thus, detection of the test patterns using a sensor or the like can be performed with ease.

In this method for detecting ejection, the color ink may be ejected from a plurality of color-ink nozzles in order to cause the color ink to adhere to the medium; specific color-ink nozzles, of among the plurality of color-ink nozzles, may respectively correspond to the test patterns; and ejection of each of those color-ink nozzles corresponding to the test patterns may be inspected using the respective test patterns. By correlating in this manner, it is possible to employ the test patterns as color-ink nozzle test patterns as well.

Further, in this method for detecting ejection, patterns that are used to inspect ejection of color-ink nozzles, of among the plurality of color-ink nozzles, that are not made to correspond to the test patterns may be formed between the test patterns. By forming such patterns, it is possible to effectively use the gaps between the test patterns. It is also possible to perform inspection of ejection for other color-inknozzles.

Further, in this method for detecting ejection, color inks of different colors may be ejected from a plurality of types of color-ink nozzles in order to cause the color inks of different colors to adhere to the medium; and each test pattern may be formed, for each clear-ink nozzle, on the medium using the clear ink that is ejected from that clear-ink nozzle and a color ink of one of the different colors. This allows for the test patterns that are used for inspecting ejection of the clear-ink nozzles to be formed dispersed among a plurality of colors of color inks.

Further, in this method for detecting ejection, color inks of different colors may be ejected from a plurality of types of color-ink nozzles in order to cause the color inks of different colors to adhere to the medium; and the test patterns may be formed on the medium using a color ink other than the color ink that is lightest in color. Using color ink other than the color ink that is lightest in color to form the test patterns on the medium allows the differences in color between when there is only color ink and when clear ink is overlapping to become conspicuous. Thus, inspection of clear-ink nozzle ejection can be performed with ease.

Further, in this method for detecting ejection, a darkness of the color when the clear ink and the color ink adhere to a same region may be different from a darkness of the color when that color ink adheres to a region to which the clear ink has not adhered. Further, a darkness of the color when the clear ink and the color ink adhere to the same region may be lighter than a darkness of the color when that color ink adheres to the region to which the clear ink has not adhered. By making the color darkness be different or be lighter, it is possible to inspect with ease whether or not clear ink is adhering.

Further, in this method for detecting ejection, each of the test patterns may be formed in a block shape. Forming the test patterns in a block-shape in this way allows ejection of the nozzles to be inspected easily.

Further, in this method for detecting ejection, the color ink may be ejected from a plurality of color-ink nozzles in order to cause the color ink to adhere to the medium; and an amount of the clear ink ejected from the clear-ink nozzles in order to form the test patterns may be different from an amount of the color ink ejected from the color-ink nozzles. Making the amount of ejection be different allows the change in color to increase, and this allows ejection of the clear-ink nozzles to be inspected with ease.

Furthermore, the amount of the clear ink ejected from the clear-ink nozzles may be less than the amount of the color ink ejected from the color-ink nozzles. Having the ejection amount of clear ink be less than the ejection amount of color ink makes it particularly easy to inspect ejection of the clear-ink nozzles.

Further, in this method for detecting ejection, whether or not there is ejection failure in the clear-ink nozzles may be checked based on detection information from a sensor for detecting the test patterns that are formed on the medium. Adopting such a configuration allows ejection of the clear-ink nozzles or color-ink nozzles to be inspected with ease.

It is also possible to achieve a method for detecting ejection such as the following.

A Method for detecting ejection of a plurality of clear-ink nozzles, comprises the steps of:

causing a color ink to adhere to a medium;

ejecting a clear ink toward the medium from each of the clear-ink nozzles;

forming on the medium test patterns that each corresponds to one of the clear-ink nozzles using the clear ink ejected from each of the clear-ink nozzles and the color ink, while leaving a space between the test patterns; and inspecting ejection of each of the clear-ink nozzles based on the test patterns formed corresponding to the respective clear-ink nozzles;

wherein color inks of different colors are ejected from a plurality of color-ink nozzles of a plurality of types, in order to cause the color inks of different colors to adhere to the medium;

wherein specific color-ink nozzles, of among the plurality of color-ink nozzles, respectively correspond to the test patterns;

wherein ejection of each of those color-ink nozzles corresponding to the test patterns is inspected using the respective test patterns;

wherein patterns that are used to inspect ejection of color-ink nozzles, of among the plurality of color-ink nozzles, that are not made to correspond to the test patterns are formed between the test patterns;

wherein each test pattern is formed, for each clear-ink nozzle, on the medium using the clear ink that is ejected from that clear-ink nozzle and a color ink of one of the different colors;

wherein the test patterns are formed on the medium using a color ink other than the color ink that is lightest in color;

wherein a darkness of the color when the clear ink and the color ink adhere to the same region is lighter than a darkness of the color when that color ink adheres to a region to which the clear ink has not adhered;

wherein each of the test patterns is formed in a block shape;

wherein an amount of the clear ink ejected from the clear-ink nozzles in order to form the test patterns is less than an amount of the color ink ejected from the color-ink nozzles; and wherein whether or not there is ejection failure in the clear-ink nozzles is checked based on detection information from a sensor for detecting the test patterns that are formed on the medium.

It is also possible to achieve a printing apparatus such as the following.

A printing apparatus comprises:

a color-ink nozzle for ejecting a color ink;

a plurality of clear-ink nozzles for ejecting a clear ink; and a controller for controlling the ejection of ink from the color-ink nozzle and the clear-ink nozzles;

wherein the controller controls the ejection of the color ink from the color-ink nozzle and the ejection of the clear ink from the clear-ink nozzles, to form on the medium test patterns that each corresponds to one of the clear-ink nozzles and that each includes the clear ink ejected from each of the clear-ink nozzles and the color ink, while leaving a space between the test patterns.

It is also possible to achieve a method for forming patterns for detecting ejection such as the following.

A method for forming patterns for detecting ejection of a plurality of clear-ink nozzles, comprises the steps of:

causing a color ink to adhere to a medium;

ejecting a clear ink toward the medium from each of the clear-ink nozzles; and forming on the medium test patterns that each corresponds to one of the clear-ink nozzles using the clear ink ejected from each of the clear-ink nozzles and the color ink, while leaving a space between the test patterns.

It is also possible to achieve a computer-readable medium such as the following.

A computer-readable medium, comprises:

a code for causing a color ink to adhere to a medium;

a code for causing a clear ink to be ejected toward the medium from each of a plurality of clear-ink nozzles; and a code for causing test patterns that each corresponds to one of the clear-ink nozzles to be formed on the medium using the clear ink ejected from each of the clear-ink nozzles and the color ink, while leaving a space between the test patterns.

It is also possible to achieve a printing system such as the following.

A printing system comprises:

a computer; and a printing apparatus that is connectable to the computer, the printing apparatus including;

a color-ink nozzle for ejecting a color ink;

a plurality of clear-ink nozzles for ejecting a clear ink; and a controller for controlling the ejection of ink from the color-ink nozzle and the clear-ink nozzles;

wherein the controller controls the ejection of the color ink from the color-ink nozzle and the ejection of the clear ink from the clear-ink nozzles, to form on the medium test patterns that each corresponds to one of the clear-ink nozzles and that each includes the clear ink ejected from each of the clear-ink nozzles and the color ink, while leaving a space between the test patterns.

===Outline of Printing Apparatus===

Figure 2:
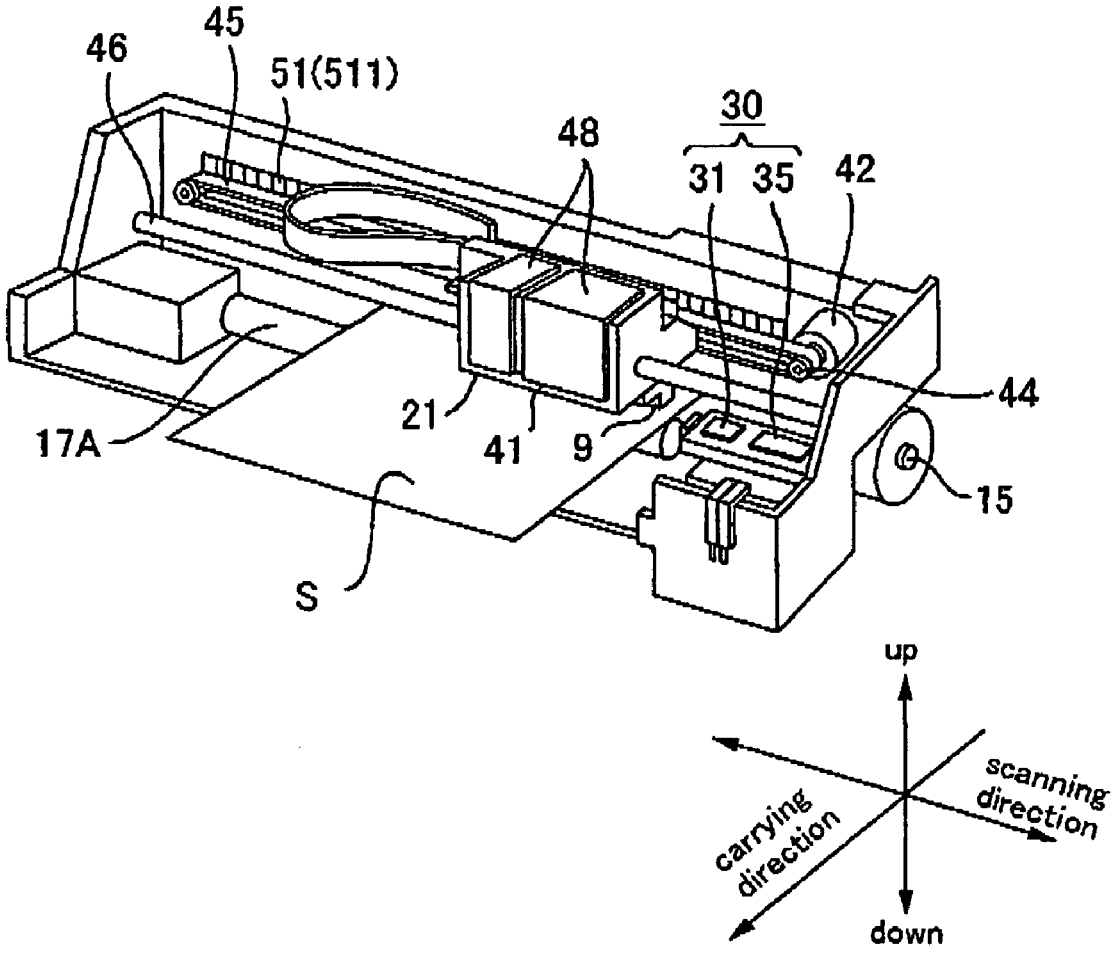
FIG. 2 is a diagram showing the internal configuration of the inkjet printer.
Figure 3:
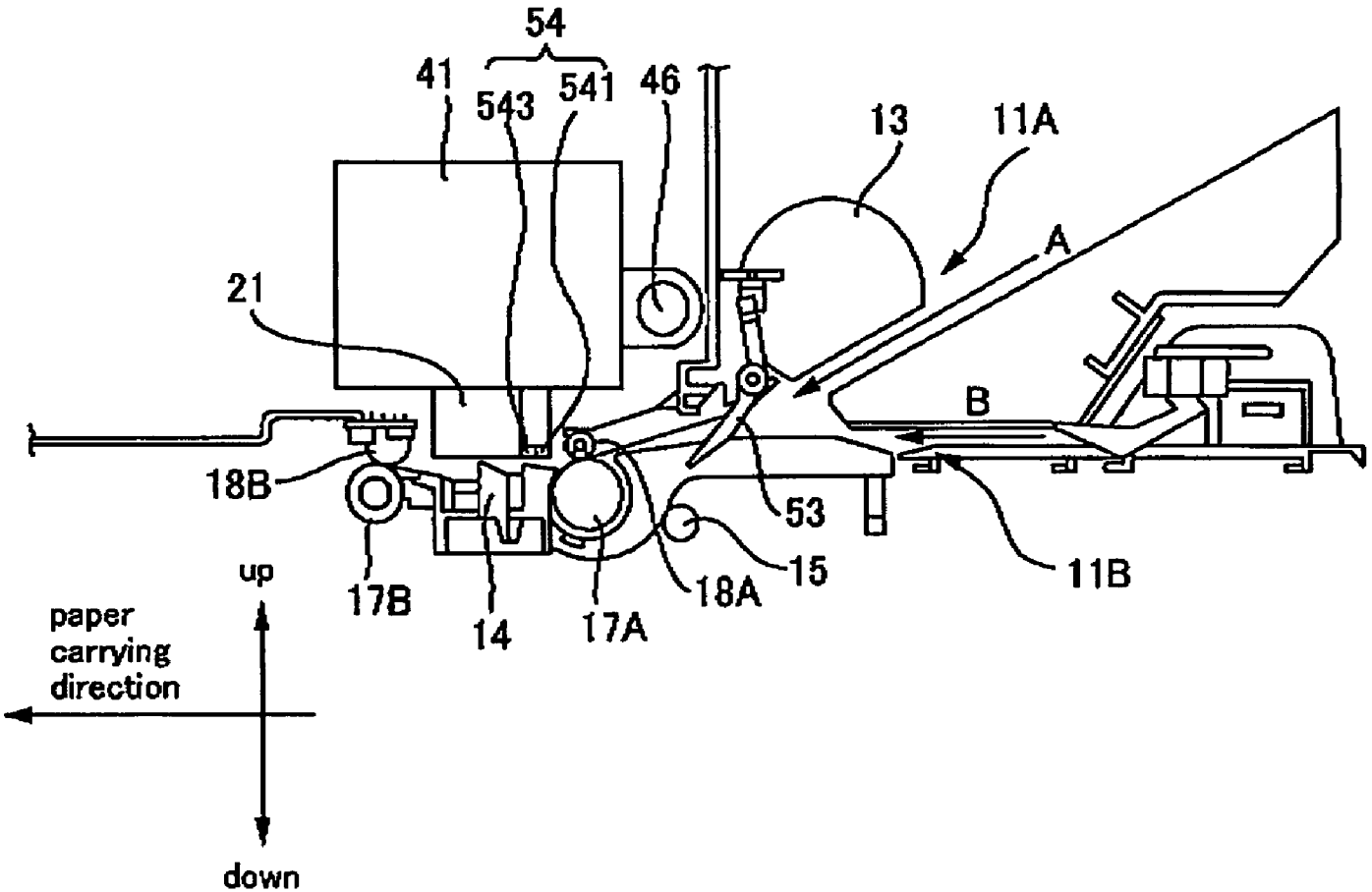
FIG. 3 is a cross sectional view of a carrying section of the inkjet printer.
Figure 4:
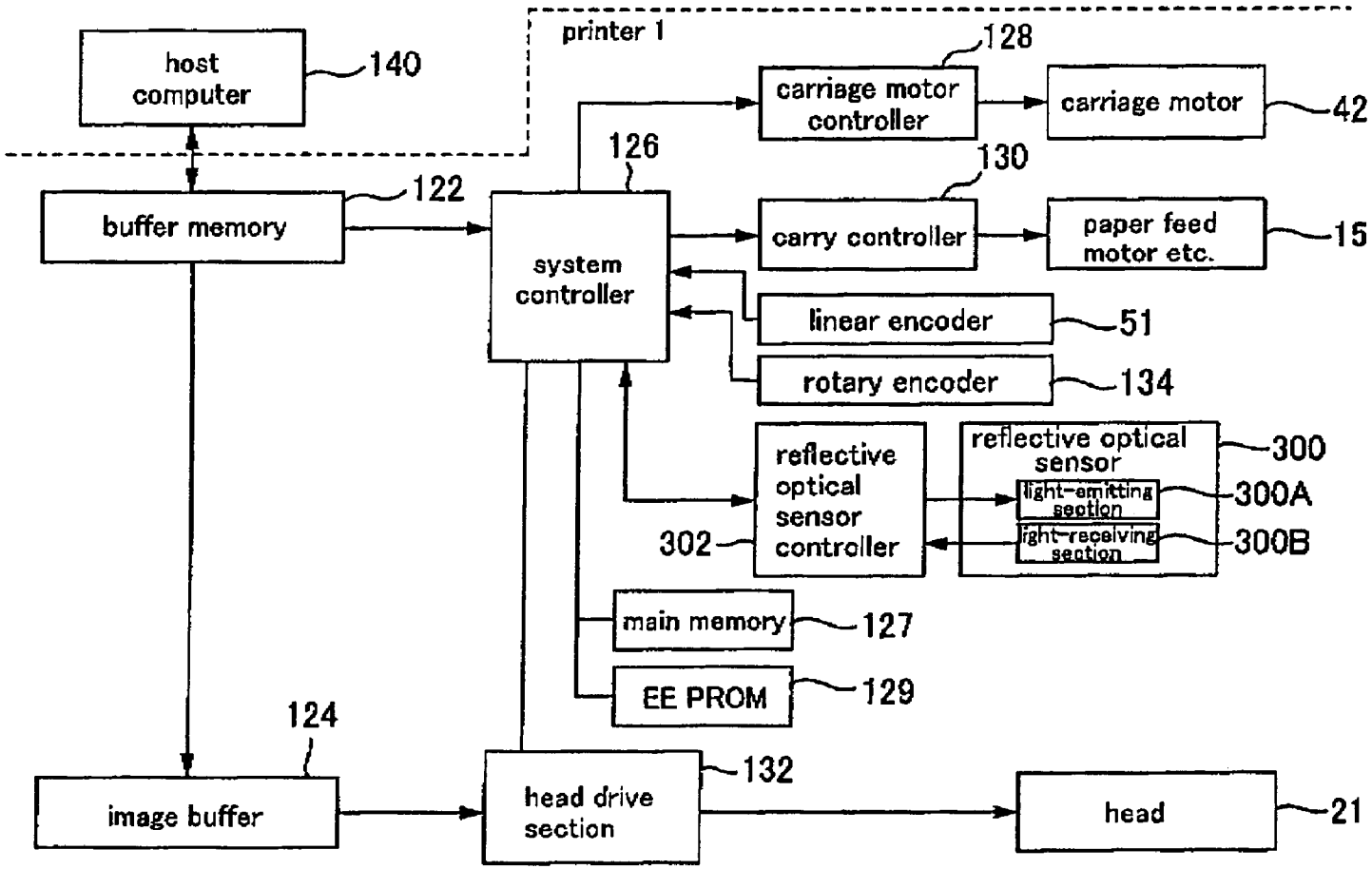
FIG. 4 is a block structural diagram showing the system configuration of the inkjet printer.

An embodiment of a printing apparatus according to the present invention is described with an inkjet printer serving as an example. FIGS. 1 to 4 show an example of an inkjet printer. FIG. 1 to FIG. 4 are diagrams for describing an overview of one embodiment of an inkjet printer 1. FIG. 1 shows the external appearance of the embodiment of the inkjet printer 1. FIG. 2 shows the internal configuration of the inkjet printer 1. FIG. 3 shows the carrying section of the inkjet printer 1. FIG. 4 is a block structural diagram showing the system configuration of the inkjet printer.

As shown in FIG. 1, the inkjet printer 1 is provided with a structure in which a medium such as print paper that is supplied from the rear side is discharged from the front side. A control panel 2 and a discharge section 3 are provided on the front side area, and a paper supply section 4 is provided on the rear side area. The control panel 2 is provided with various types of control buttons 5 and display lamps 6. The paper discharge section 3 is provided with a paper discharge tray 7 that blocks the paper discharge opening when the inkjet printer is not in use. The paper supply section 4 is provided with a paper supply tray 8 for holding cut paper (not shown). It should be noted that it is also possible for the inkjet printer 1 to be provided with a paper feed structure that is capable of printing not only print paper in single sheets, such as cut paper, but also continuous such as roll paper.

AS shown in FIG. 2, a carriage 41 is arranged inside the inkjet printer 1. The carriage 41 is arranged such that it can move in a relative manner in a predetermined direction (in this embodiment, the scanning direction shown in the drawing). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a drive source for moving the carriage 41 in a relative manner in the predetermined direction. Furthermore, the timing belt 45 is connected to the carriage motor 42 via the pulley 44 and a portion thereof is also connected to the carriage 41, such that the carriage 41 is moved in a relative manner in the predetermined direction by the rotational driving of the carriage motor 42. The guide rail 46 guides the carriage 41 in the predetermined direction. In addition to these, also provided in the vicinity of the carriage 41 are a linear encoder 51 that detects the position of the carriage 41, a carry roller 17A for carrying a medium S in a direction that intersects the movement direction of the carriage 41, and a paper feed motor 15 that rotationally drives the carry roller 17A.

On the other hand, ink cartridges 48 that contain various inks and a print head 21 for executing printing with respect to the medium S are provided in the carriage 41. The ink cartridges 48 contain color inks such as yellow (Y), magenta (M), cyan (C), black (K), light magenta (LM), light cyan (LC), and dark yellow (DY), and are removably mounted to a carriage mounting section provided in the carriage 41. On the other hand, in this embodiment, the print head 21 carries out printing by ejecting ink onto the medium S. For this reason, numerous nozzles for ejecting ink are provided in the print head 21. Detailed description of the ink ejecting mechanism of the print bead 21 is provided later.

Additionally, a cleaning unit 30 for eliminating clogging of the nozzles of the print head 21 is arranged inside the inkjet printer 1. The cleaning unit 30 has a pump device 31 and a capping device 35. The pump device 31 sucks out ink from the nozzles in order to prevent clogging of the nozzles of the print head 21, and is operated by a pump motor (not shown). On the other hand, the capping device 35 is for sealing the nozzles of the head 21 when printing is not being performed (during standby etc.) so as to keep the nozzles of the head 21 from clogging.

The following is a description of the configuration of the carrying section (which corresponds to the carrying means of the present invention) of the inkjet printer 1. As shown in FIG. 3, the carrying section has a paper insert opening 11A and a roll paper insert opening 11B, a paper supply motor (not shown), a paper supply roller 13, a platen 14, a paper feed motor (hereinafter, also referred to as PP motor) 15, the carry roller 17A and paper discharge rollers 17B, and free rollers 18A and free rollers 18B.

The paper insert opening 11A is where the paper S, which is a medium, is inserted. The paper supply motor (not shown) is a motor for carrying the paper S that has been inserted into the paper insert opening 11A into the printer 1, and is constituted by a pulse motor or the like. The paper supply roller 13 is a roller for automatically carrying the medium S that has been inserted into the paper insert opening 11A into the printer 1, and is driven by the paper supply motor. The paper supply roller 13 has a transverse cross-sectional shape that is substantially the shape of the letter D. The peripheral length of a circumference section of the paper supply roller 13 is set longer than the carrying distance up to the PF motor 15, so that using this circumference section the medium S can be carried up to the PF motor 15. It should be noted that a plurality of the medium S are prevented from being supplied at one time by the rotational drive force of the paper supply roller 13 and the friction resistance of separating pads (not shown).

The platen 14 is a support means that supports the paper S during printing. The PF motor 15 is a motor for feeding paper, which is an example of the medium S, in the paper carrying direction, and is constituted by a DC motor. The carry roller 17A is a roller for feeding the paper S that has been carried into the printer 1 by the paper supply roller 13 to a printable region, and is driven by the PF motor 15. The free rollers 18A are provided in a position that is in opposition to the carry roller 17A, and push the paper S toward the carry roller 17A by sandwiching the paper S between them and the carry roller 17A.

The paper discharge rollers 17B are rollers for discharging the paper S for which printing has finished to outside the printer 1. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The following is a description of the system configuration of the inkjet printer 1. As shown in FIG. 4, the inkjet printer 1 is provided with a buffer memory 122, an image buffer 124, a system controller 126, which is an example of a controller, a main memory 127, and an EEPROM 129. The buffer memory 122 receives and temporarily stores various data such as print data sent from a host computer 140. The image buffer 124 obtains the received print data from the buffer memory 122 and stores it. The main memory 127 is constituted by a ROM or a RAM for example.

On the other hand, the system controller 126 reads out a control program from the main memory 127 and executes overall control of the main printer unit 20 in accordance with that control program. The system controller 126 of the present embodiment is connected to a carriage motor controller 128, a carry controller 130, a head drive section 132, a rotary encoder 134, and a linear encoder 51. The carriage motor controller 128 performs driving control of the rotation direction, number of rotations, torque and the like of the carriage motor 42. Also, the head drive section 132 performs driving control of the print head 21. The carry controller 130 controls the various drive motors that are arranged in the carry system, such the paper feed motor 15 that rotatively drives the carry roller 17A.

Print data that have been sent from the host computer 140 are temporarily held in the buffer memory 122. Necessary information contained in the print data held here is read out by the system controller 126. Based on the information that is read out, the system controller 126 controls the carriage motor controller 128, the carry controller 130, and the head drive section 132 in accordance with the control program while referencing the output from the linear encoder 51 and the rotary encoder 134.

Print data for a plurality of color components received by the buffer memory 122 is stored in the image buffer 124. The head drive section 132 obtains the print data of the various color components from the image buffer 124 in accordance with control signals from the system controller 126, and performs driving control of the nozzles of the various colors provided in the print head 21 based on the print data.

In addition, the system controller 126 of the present embodiment is provided with a reflective optical sensor controller 302. The reflective optical sensor controller 302 performs driving control of a reflective optical sensor 300. The reflective optical sensor 300 is provided with a light-emitting section 300A constituted by a light-emitting diode or the like and a light-receiving section 300B constituted by a phototransistor or the like. The reflective optical sensor controller 302 functions to control light-emission of the light-emitting section 300A of the reflective optical sensor 300 and to transmit information related to the reflected light received by the light-receiving section 300B to the system controller 126. The reflective optical sensor 300 is provided in the carriage 41 in such a manner that it can emit light onto the medium S from the light-emitting section 300A.

===Example Configuration of the Reflective Optical Sensor===

Figure 5:
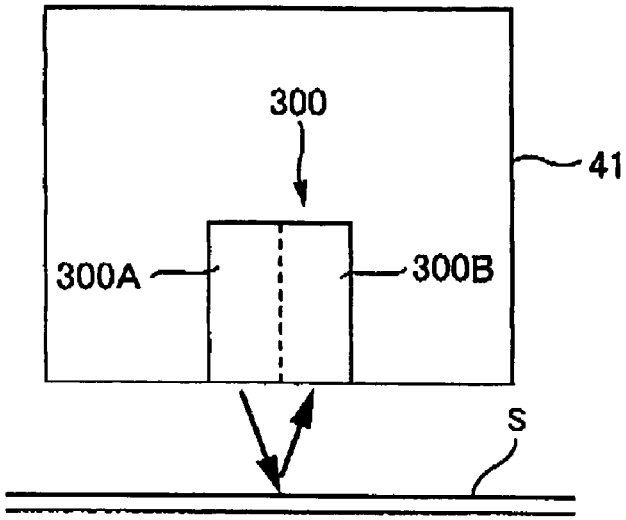
FIG. 5 is an explanatory diagram showing a configuration of a reflective optical sensor.

FIG. 5 is a schematic diagram showing an embodiment in which the reflective optical sensor 300 is used as a sensor. As shown in this drawing, the reflective optical sensor 300 is provided in the carriage 41 and is moved with the carriage 41 in a relative manner with respect to the medium S.

The light-emitting section 300A of the reflective optical sensor 300 is set up such that light is irradiated toward the medium S at a predetermined angle. Conversely, the light-receiving section 300B detects the light that is reflected by the surface of the medium S (including regular reflection light and diffused reflection light). Thus, the reflective optical sensor 300 measures the amount of reflected light received by the light-receiving section 300B and detects, for example, the degree of luster of the medium S and color darkness. The results of the detection by the reflective optical sensor 300 are output to the system controller 126.

It should be noted that in this embodiment the light-emitting section 300A and the light-receiving section 300B are disposed adjacent to one another, but they may be separately disposed with a space between them.

===Linear Encoder===

Figure 6:
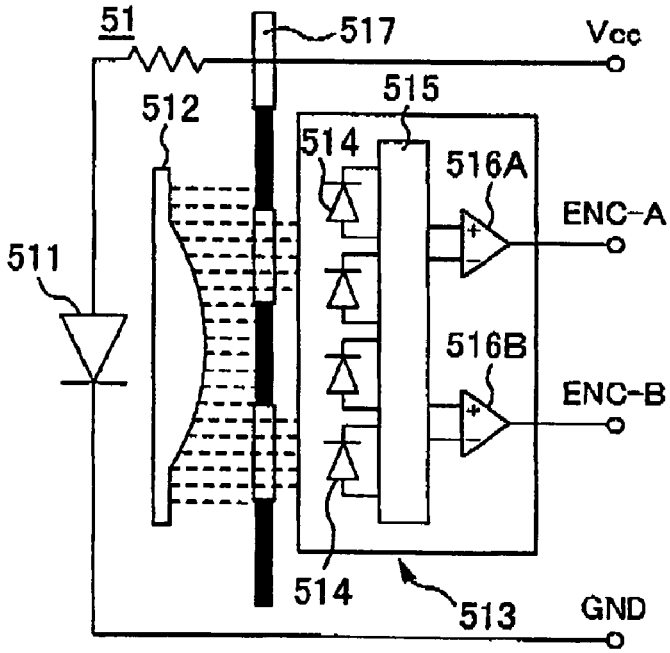
FIG. 6 is an explanatory diagram of a linear encoder.

The linear encoder 51 is described in detail next. FIG. 6 schematically shows the configuration of the linear encoder 51 provided in the carriage 41.

The linear encoder 51 is provided with a light-emitting diode 511, a collimating lens 512, and a detection processing section 513. The detection processing section 513 has a plurality (for instance, four) photodiodes 514, a signal processing circuit 515, and for example two comparators 516A and 516B.

The light-emitting diode 511 emits light when a voltage VCC is applied to it via resistors on both sides. This light is condensed into parallel light by the collimating lens 512 and passes through a linear encoder code plate 517. The linear encoder code plate 517 is provided with slits at a predetermined spacing (for example, 1/180 inch (one inch=2.54 cm)).

The parallel light that passes through the linear encoder code plate 517 then passes through stationary slits (not shown) and is incident on the photodiodes 514, where it is converted into electric signals. The electric signals that are output from the four photodiodes 514 are subjected to signal processing in the signal processing circuit 515, and the signals that are output from the signal processing circuit 515 are compared in the comparators 516A and 516B, and the results of these comparisons are output as pulses. The pulse ENC-A and the pulse ENC-B that are output from the comparators 516A and 516B become the output of the linear encoder 51.

FIG. 7A is a timing chart showing the waveforms of two output signals of the linear encoder 51 when the carriage motor 42 is rotating forward. FIG. 7B is a timing chart showing the waveforms of two output signals of the linear encoder 51 when the carriage motor 42 is rotating in reverse.

AS shown in FIGS. 7A and 7B, the phases of the pulse ENC-A and the pulse ENC-B are misaligned by 90 degrees both when the carriage motor 42 is rotating forward and when it is rotating in reverse. When the carriage motor 42 is rotating forward, that is, when the carriage 41 is moving along the guide rail 46, then, as shown in FIG. 7A, the phase of the pulse ENC-A leads the phase of the pulse ENC-B by 90 degrees, whereas when the carriage motor 42 is rotating in reverse, then, as shown in FIG. 7B, the phase of the pulse ENC-A trails the phase of the pulse ENC-B by 90 degrees. A single period T of the pulse ENC-A and the pulse ENC-B is equivalent to the time during which the carriage 41 is moved by the slit spacing of the linear encoder code plate 517.

Then, the rising edge and the rising edge of the output pulses ENC-A and ENC-B of the linear encoder 51 are detected, the number of detected edges is counted, and the rotational position of the carriage motor 42 is calculated based on the value of the count. As regards this calculation, when the carriage motor 42 is rotating forward, a "+1" is added for each detected edge, and when it is rotating in reverse, a "−1" is added for each detected edge. The period of the pulses ENC-A and ENC-B is equal to the time from when one slit of the linear encoder code plate 517 passes through the linear encoder 51 to when the next slit passes through the linear encoder 51, and the phases of the pulse ENC-A and the pulse ENC-B are misaligned by 90 degrees.

Accordingly, a count value of "1" corresponds to ¼ of the slit spacing of the linear encoder code plate 517. Therefore, if the count value is multiplied by ¼ of the slit spacing, then the amount that the carriage motor 42 has moved from the rotational position corresponding to the count value "0" can be obtained based on this product. The resolution of the linear encoder 51 at this time is ¼ the slit spacing of the linear encoder code plate 517.

===Print Head===

Figure 8:
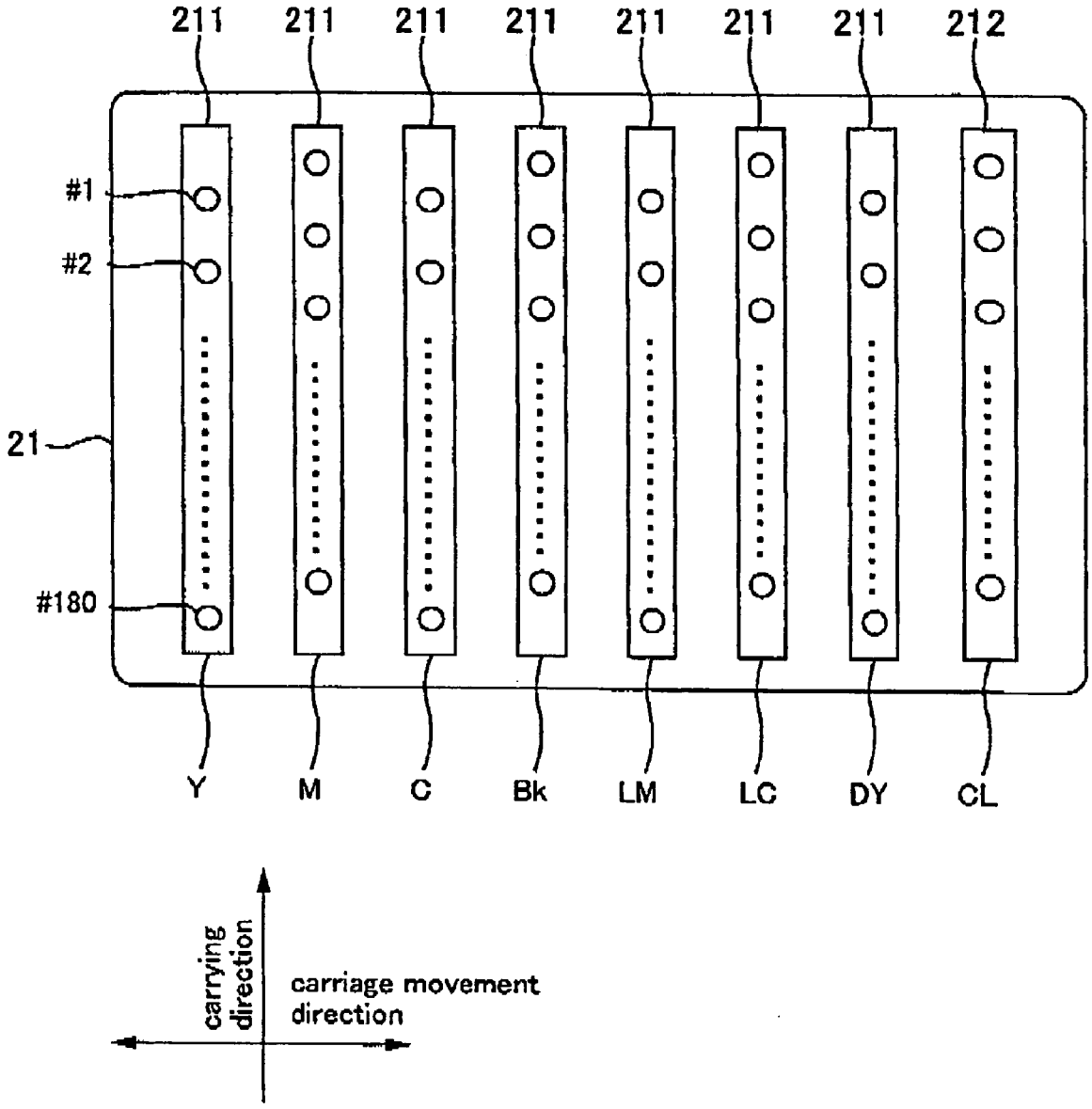
FIG. 8 is a diagram showing the print head as viewed from its lower surface.

FIG. 8 shows the arrangement of ink nozzles provided on the lower surface portion of the print head 21. As shown in the drawing, a nozzle row 211 made of a plurality of nozzles #1 to #180 is arranged on the lower surface portion of the print head 21 for each of the colors yellow (Y), magenta (M), cyan (c), black (Bk), light magenta (LM), light cyan (LC), and dark yellow (DY). Moreover, in this embodiment, in addition to the nozzle rows 211 for these colors, there is also provided a nozzle row 212 for clear ink (CL). It should be noted that the nozzles #1 to #180 of the nozzle rows 211 for each of the colors yellow (Y), magenta (M), cyan (C), black (Bk), light magenta (LM), light cyan (LC), and dark yellow (DY) correspond to the color-ink nozzles of the present invention, and the nozzles #1 to #180 of the nozzle row 212 for clear ink (CL) correspond to the clear-ink nozzles of the present invention.

The nozzles #1 to #180 of the nozzle rows 211 and 212 are arranged linearly in the carrying direction of the paper S. The nozzle rows 211 and 212 are disposed in parallel with space between them in the movement direction (scanning direction) of the print head 21. The nozzles #1 to #180 are each provided with a piezo element (not shown) as a drive element for ejecting ink droplets.

When a voltage of a predetermined duration is applied between electrodes provided on both ends of a piezo element, the piezo element expands for the duration of voltage application and deforms a lateral wall of the ink channel. As a result, the volume of the ink channel is constricted by an amount according to the expansion of the piezo element, and ink corresponding to this amount of constriction becomes an ink droplet and is ejected from the relevant color nozzle #1 to #180.

Figure 9:
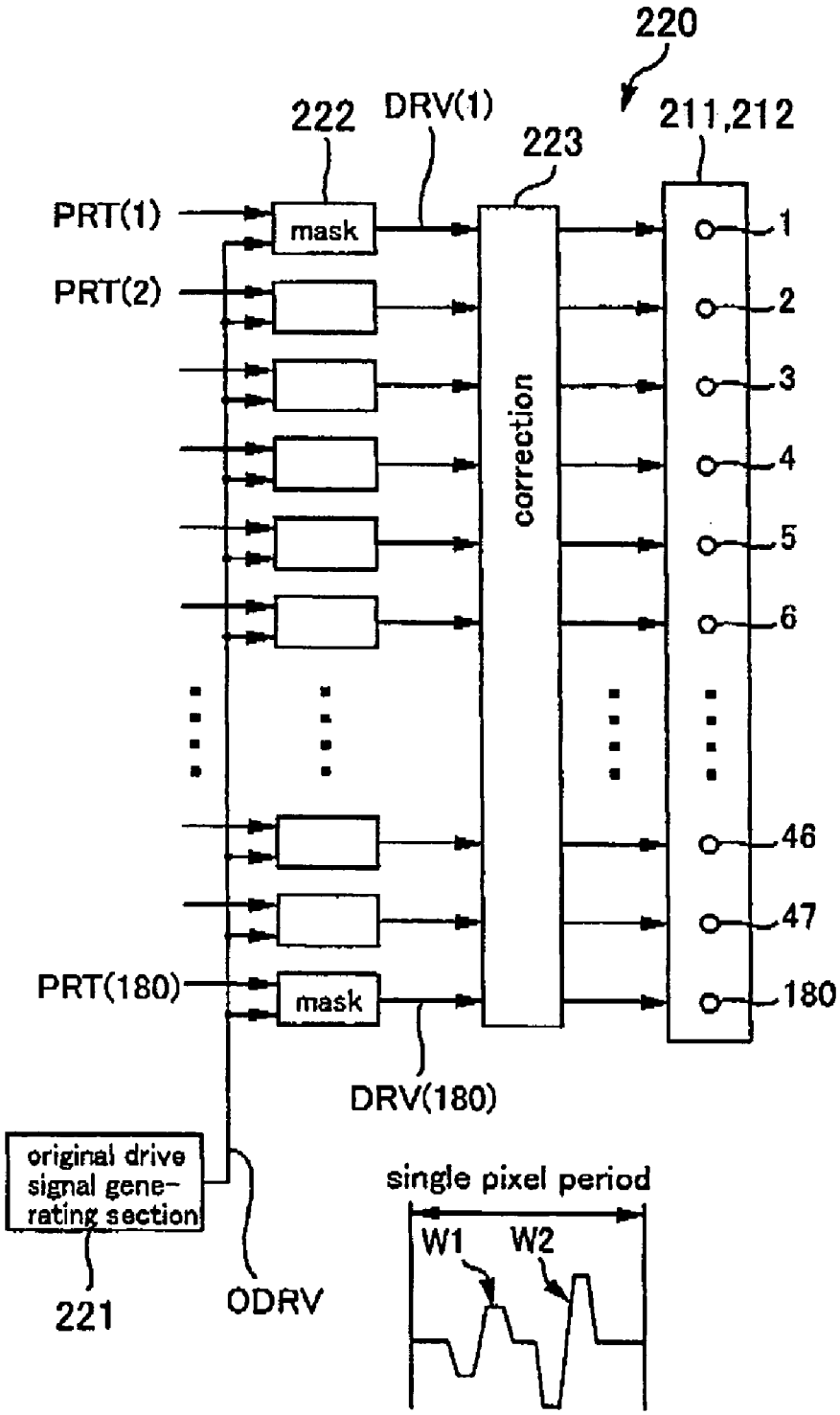
FIG. 9 is a circuit diagram showing an embodiment of a nozzle drive circuit.

FIG. 9 shows a drive circuit 220 of the nozzles #1 to #180. As shown in FIG. 9, the drive circuit 220 is provided with an original drive signal generating section 221, a plurality of mask circuits 222, and a drive signal correction circuit 223. The original drive signal generating section 221 generates an original signal ODRV that is shared by the nozzles #1 to #180. As shown in a lower portion of FIG. 9, the original signal ODRV is a signal that includes two pulses, a first pulse W1 and a second pulse W2, during the main scanning period of a single pixel (during the period of time that the carriage 41 crosses over a single pixel). The original signal ODRV generated by the original drive signal generating section 221 is output to each mask circuit 222.

The mask circuits 222 are provided corresponding to each of the plurality of piezo elements for driving the nozzles #1 to #180 of the print head 21. The mask circuits 222 receive the original signal ODRV from the original signal generating section 221 and also receive the print signals PRT(i). The print signals PRT(i) are pixel data corresponding to pixels and are binary signals having 2-bit information per pixel. The bits respectively correspond to the first pulse W1 and the second pulse W2. The mask circuits 222 are gates for blocking the original signal ODRV or allowing it to pass depending on the level of the print signal PRT(i). That is, when the print signal PRT(i) is level "0," the pulse of the original signal ODRV is blocked, but when the print signal PRT(i) is level "1," the pulse corresponding to the original signal ODRV is allowed to pass unchanged and is output to the drive signal correction circuit 223 as a drive signal DRV.

The drive signal correction circuit 223 performs correction by shifting the timing of the waveforms of the drive signals DRY which have been sent from the mask circuits 222. The width by which the timing of the waveforms of the drive signals DRV, which are corrected here, is shifted is adjusted as appropriate based on instructions from the system controller 126 for example. That is, based on instructions from the system controller 126 etc., the drive signal correction circuit 223 can shift the waveforms of the drive signals DRV to a desired timing. The drive signals DRV that are corrected by the drive signal correction circuit 223 are output to the piezo elements of the nozzles #1 to #10. The piezo elements of the nozzles #1 to #10 are driven in accordance with the drive signals DRV from the drive signal correction circuit 223 and execute the ejection of ink.

Figure 10:
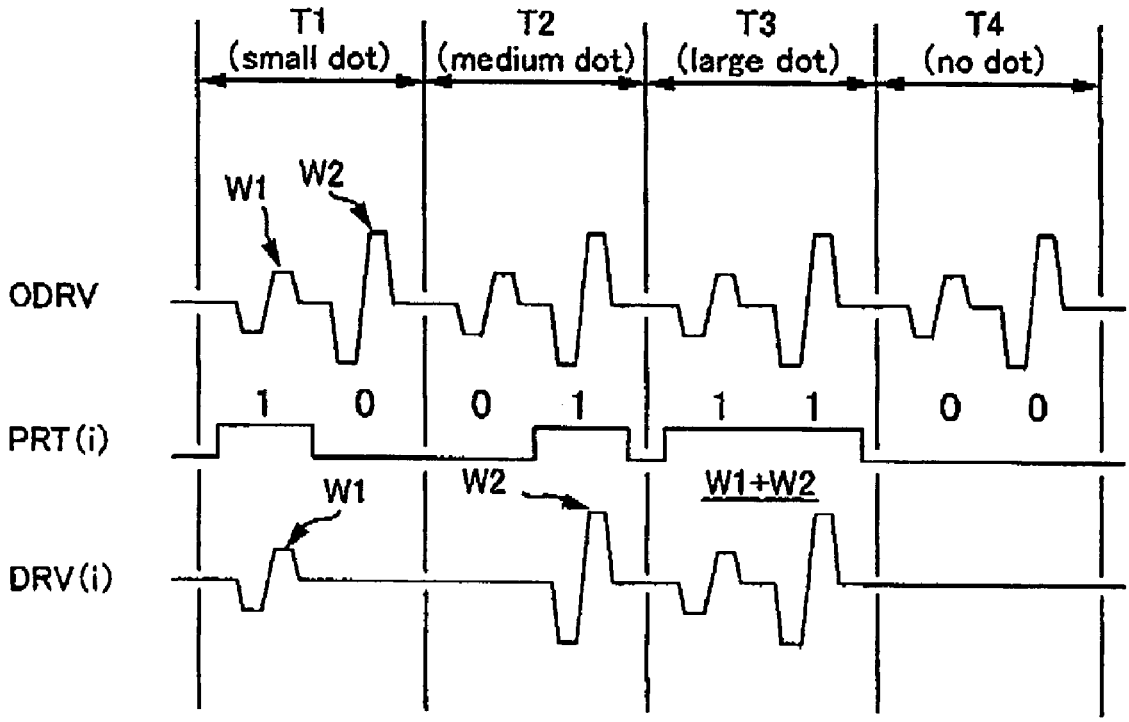
FIG. 10 is a timing chart of the original signal ODRV, the print signal PRT(i), and the drive signal DRV(i) indicating the operation of the drive signal generating section.

FIG. 10 is a timing chart of the original signal ODRV, the print signal PRT(i), and the drive signal DRV(i) indicating the operation of the drive signal generating section. AS shown in this diagram, the original signal ODRV generates a first pulse W1 and a second pulse W2 in that order during each pixel period T1, T2, T3, and T4. It should be noted that "pixel period" has the same meaning as the movement period of the carriage 41 for a single pixel.

When the print signal PRT(i) corresponds to the two bits of pixel data "1,0" then only the first pulse W1 is output in the first, half of the pixel period. Accordingly, a small ink droplet is ejected from the nozzle, forming a small-sized dot (small dot) on the medium S. When the print signal PRT(i) corresponds to the two bits of pixel data "0,1" then only the second pulse W2 is output in the second half of the pixel period. Accordingly, a medium-sized ink droplet is ejected from the nozzle, forming a medium-sized dot (medium dot) on the medium S. Furthermore, when the print signal PRT(i) corresponds to the two bits of pixel data "1,1" then the first pulse W1 and the second pulse W2 are both output during a single pixel period. Accordingly, a large ink droplet is ejected from the nozzle, forming a large-sized dot (large dot) on the medium S. As described above, the drive signal DRV(i) in a single pixel period is shaped so that it may have three different waveforms corresponding to three different values of the print signal PRT(i), and based on these signals, the print head 21 can form dots of three different sizes and can adjust the amount of ejected ink during each pixel period. When the print signal PRT(i) corresponds to the two bits of pixel data "0,0" as in the pixel period T4, then no ink droplet is ejected from the nozzle and a dot is not formed on the medium S.

In the inkjet printer 1 according to the present embodiment, drive circuits 220 of the nozzles #1 to #180 are provided separately for each of the nozzle rows 211 and 212, that is, for each of the colors yellow (Y), magenta (M), cyan (C), black (Bk), light magenta (LM), light cyan (LC), and dark yellow (DY), and for clear ink (CL), such that the driving of the piezo elements is carried out separately for each nozzle row 211 and 212.

===Color Inks and Clear Ink===

The color inks and the clear ink of the present invention are described here.

"Color ink" here refers to colored, non-transparent inks such as yellow (Y), magenta (M), cyan (C), black (K), light magenta (LM), light cyan (LC), and dark yellow (DY).

These color inks are dye inks or pigment inks, for example, and examples of their color include green (G), violet (V), and red (R).

"Clear ink" generally refers to ink that, in contrast to color inks, is uncolored and transparent. Here, clear inks are not particularly limited to such uncolored transparency, and broadly refers to inks that are colored and transparent or those that are colored and non-transparent but that are difficult for various types of sensors, such as the above-described reflective optical sensor, to detect when printed on the medium S. That is, colored, non-transparent color inks such as yellow (Y), magenta (M), cyan (C), and black (K) can be detected by the sensor mounted in the printing apparatus, such as the reflective optical sensor 300, when they have adhered to the medium S, and on the other hand, clear inks are inks that, even when adhering to the medium S, are extremely difficult for a sensor to specify whether or not they are adhering to the medium S.

===Ejection Detection Procedure===

With the inkjet printer 1 according to the present embodiment, it is possible to inspect whether or not the aforementioned color inks and clear ink are being properly ejected from the nozzles #1 to #180 of the nozzle rows 211 and 212, that is, it is possible to "detect missing dots." This ejection inspection involves actually ejecting color inks or clear ink from the nozzles #1 to #180 to form a predetermined test pattern on the medium S. This inspection also involves checking for whether or not there is ejection failure such as clogging in the nozzles #1 to #180 of the nozzle rows based on the test patterns that are formed. If this checking leads to the detection of ejection failure among the nozzles #1 to #180, then cleaning is executed for the nozzles #1 to #180.

Figure 11:
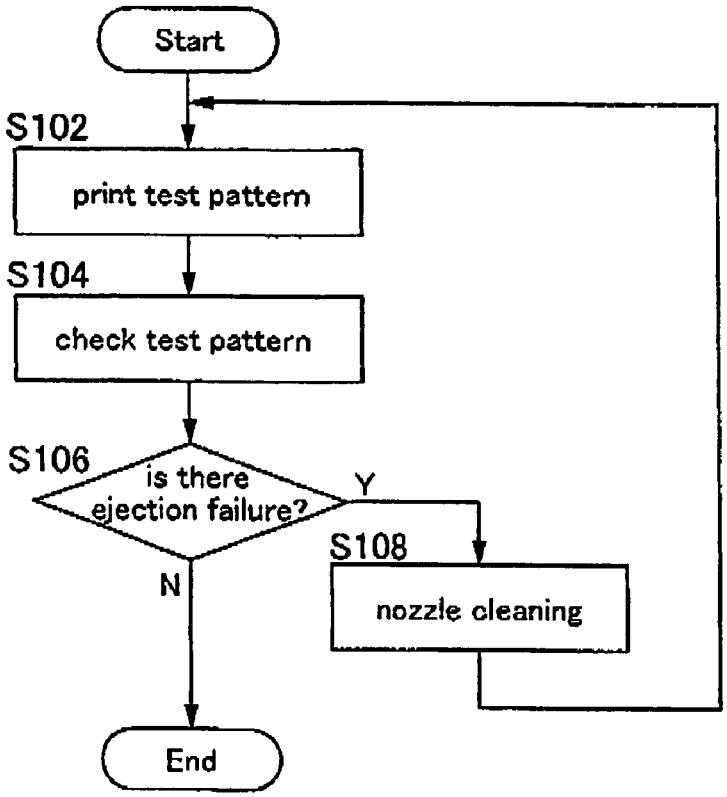
FIG. 11 is a flowchart showing an example of the procedure for inspecting ejection.

FIG. 11 shows an example of the procedure for inspecting ejection of the inkjet printer 1 according to the present embodiment. As shown in FIG. 11, when carrying out inspection of ejection, first, color ink or clear ink is ejected from the nozzles #1 to #180 of the nozzle rows 211 or 212 to form a predetermined test pattern on the medium S (S102). It should be noted that with the inkjet printer 1 according to the present embodiment, the test patterns that used for inspecting ejection of the nozzles #1 to #180 of the various color-ink nozzle rows 211 and the test pattern that is used to inspect ejection of the nozzles #1 to #180 of the clear-ink nozzle row 212 are formed simultaneously. The test patterns that are formed here are described in further detail later.

After forming the predetermined test pattern in this way, checking is carried out next based on the test pattern that has been formed (S104). This checking is carried out using the reflective optical sensor 300 that is mounted on the carriage 41 of the inkjet printer 1. The reflective optical sensor 300 detects the test pattern that has been formed on the medium S and, based on the results of this evaluation, it determines whether or not there is ejection failure among the nozzles #1 to #180 of the color-ink nozzle rows 211 or the nozzles #1 to #180 of the clear-ink nozzle row 212 (S106). If it is determined here that there is an ejection failure, nozzle cleaning is performed (S108). A detailed description of nozzle cleaning is provided later. Conversely, if it is determined that there is no ejection failure in any of the nozzle rows 211 or 212, then the process is ended immediately.

It should be noted that, although described later in greater detail, in the present embodiment, when inspecting ejection of a plurality of clear-ink nozzles, a color ink to made to adhere to a medium;

a clear ink is ejected toward the medium from each of the nozzles #1 to #180 of the clear-ink nozzle row 212;

test patterns that each corresponds to one of the clear-ink nozzles are formed on the medium using the clear ink ejected from each of the nozzles #1 to #180 of the clear-ink nozzle row 212 and the color ink, while leaving a space between the test patterns; and ejection of each of the clear-ink nozzles is inspected based on the test patterns formed corresponding to the respective clear-ink nozzles.

Also, the system controller 126 (see FIG. 4), serving as an example of the controller, controls the ejection of color ink from the color-ink nozzles and the ejection of clear ink from the nozzles #1 to #180 of the clear-ink nozzle row 212 to form on the medium test patterns that each corresponds to one of the clear-ink nozzles and that each includes the clear ink ejected from each of the clear-ink nozzles and the color ink, while leaving a space between the test patterns.

Further, the operation for inspecting ejection that is described below is achieved by the system controller 126, which is an example of the controller, controlling the various sections of the main printer unit 20. Also, a program for carrying out this operation for inspecting ejection is stored on a computer-readable medium such as a ROM, a RAM, a magnetic tape, or a CD-ROM.

===Test Patterns===

The test pattern that is formed by the inkjet printer 1 according to the present embodiment is described next. In this embodiment, test patterns 412 that are used to inspect ejection of each of the nozzles #1 to #180 of the color-ink nozzle rows 211 of the various colors and the test patterns that are used to inspect ejection of the nozzles #1 to #180 of the clear-ink nozzle row 212 are formed as a single pattern.

Figure 12:
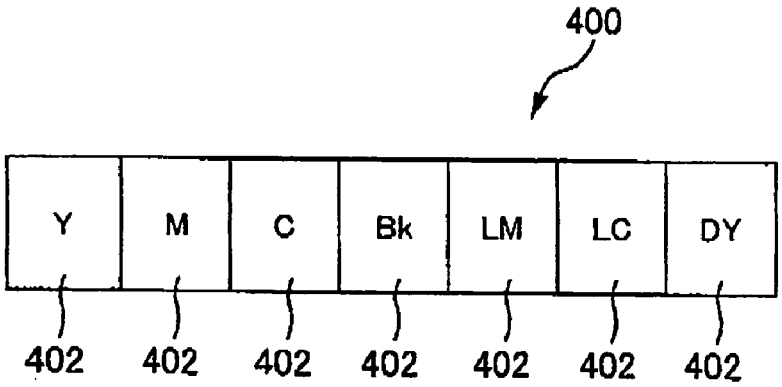
FIG. 12 is a diagram showing an example of a test pattern for the color inks and the clear ink.

FIG. 12 provides an overview of a test pattern 400 that is formed here and that is used to inspect ejection of each of the nozzles #1 to #180 of the color-ink nozzle rows 211 of the various colors and the clear-ink nozzle row 212.

As shown in this diagram, the test pattern 400 that is formed in the present embodiment is made of rectangular patterns 402 each formed by the color inks yellow (Y), magenta (M), cyan (C), black (Bk), light magenta (LM), light cyan (LC), and dark yellow (DY). In this embodiment, as shown in the diagram, the block-shaped patterns 402 for each color are formed disposed in a horizontal row in the movement direction of the carriage 41. Within each of the patterns 402 for each color are formed block-shaped patterns each corresponding to one of the nozzles #1 to #180 of a respective color. Also, although they cannot be seen in this figure, the test patterns for inspecting ejection of the clear-ink nozzle row 212 are formed integrated into some parts of these color block-shaped patterns 402.

Figure 13:
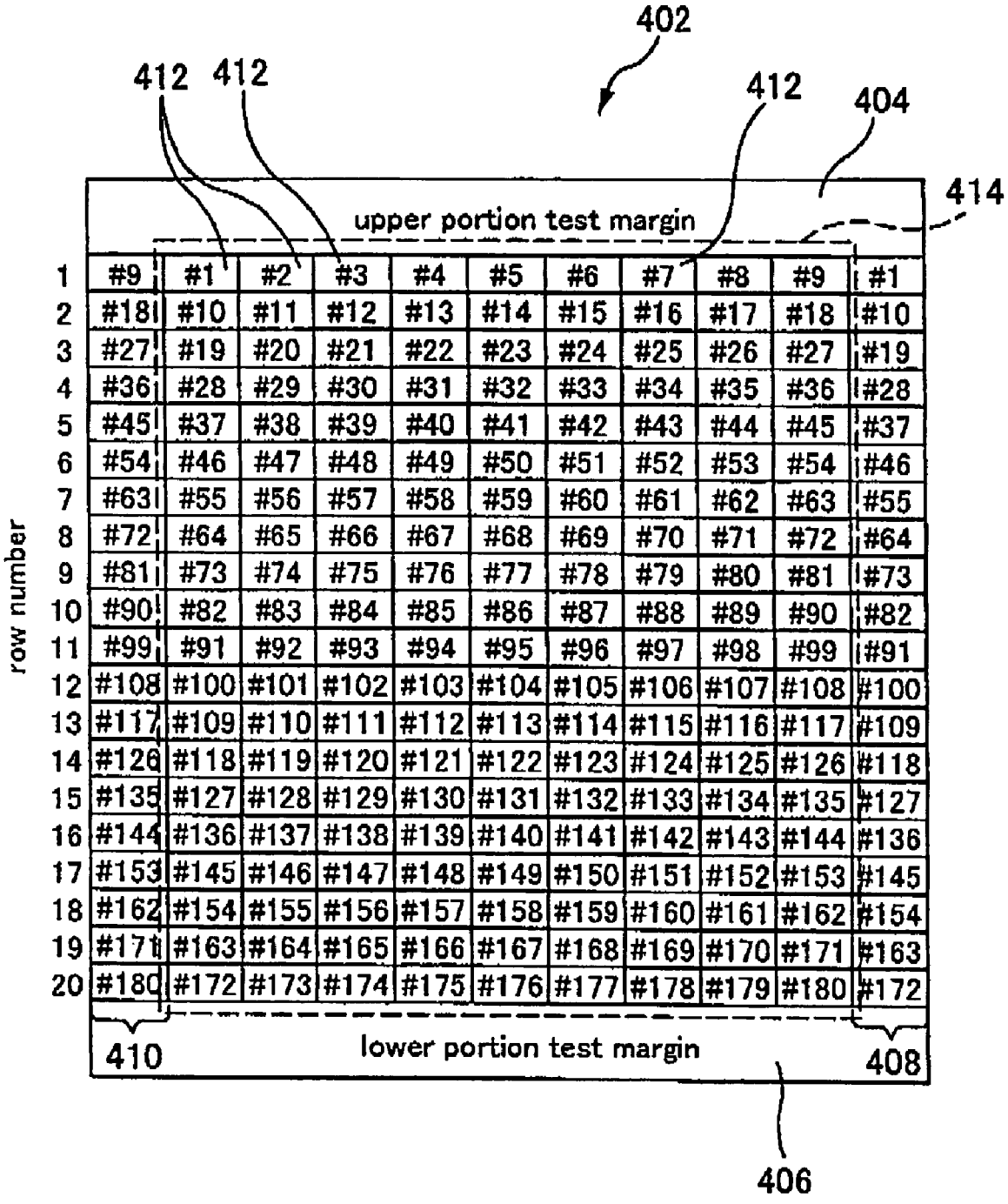
FIG. 13 is a detailed view of a test pattern of a given color.

FIG. 13 shows a magnification of the configuration of the block-shaped patterns 402, illustrating them in greater detail. As shown in FIG. 13, the patterns 402 are provided with an upper portion test margin 404, a lower portion test margin 406, a right portion test margin 408, and a left portion test margin 410 in its upper, lower, left, and right side portions, and a test-pattern group 414 for each nozzle constituted by a plurality of the block-shaped test patterns 412 is formed therein enclosed by the test margins 404, 406, 408, and 410. The upper portion test margin 404 is formed by the color ink that is ejected from the nozzles #1 to #8 and #10 to #17 of a color-ink nozzle row 211 of a given color, and the lower portion test margin 406 is formed by the color ink that is ejected from the nozzles #163 to #170 and #172 to #179 of the color-ink nozzle row 211 of that color. The right portion test margin 408 and the left portion test margin 410 are formed by the color ink that is ejected from the nozzles corresponding to the nozzle number (#1 to #180) shown in the drawing of the respective color-ink nozzle row 211.

On the other hand, each of the test patterns 412 that are formed in the test-pattern group 414 for each nozzle is formed by the color ink that is ejected respectively from the nozzle corresponding to the nozzle numbers (#1 to #180) shown in the drawing of the respective color-ink nozzle row 211. That is, a single test pattern 412 is associated with a single nozzle of each color-ink nozzle row 211, and each block-shaped pattern 412 is formed only by color ink ejected from that corresponding nozzle. In other words, test patterns 412 corresponding to all nozzles #1 to #180 of a particular nozzle row 211 are formed in the test-pattern group 414 for each nozzle. In this embodiment, the block-shaped test patterns 412 are made of 20 rows in the paper plane vertical direction (carrying direction of the medium S) and 9 columns in the paper plane horizontal direction (movement direction of the carriage 41), amounting to a total of 180 patterns, that is, the number of patterns that is provided is equal to the number of nozzles #1 to #180.

Figure 14:
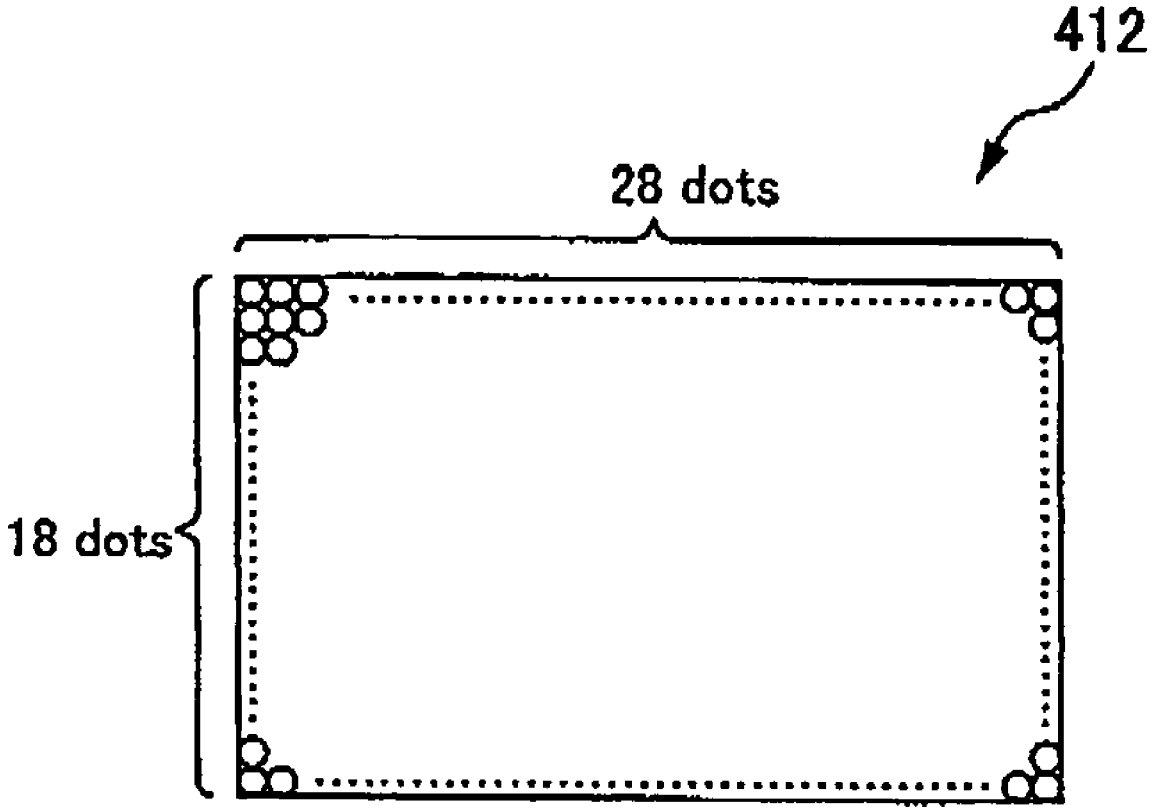
FIG. 14 is a detailed view of a pattern for each nozzle.

FIG. 14 describes in detail a single block-shaped test pattern 412 formed in the test-pattern group 414 for each nozzle. As shown in this drawing, a single test pattern 412 for each nozzle is made of numerous dots that are formed by the color ink, which is ejected from a color-ink nozzle, adhering to the medium S. Each dot is formed with a suitable space between itself and other dots in the paper plane horizontal direction (movement direction of the carriage 41) and the paper plane vertical direction (carrying direction of the medium S). Here, each test pattern 412 is made of 28 dots in the paper plane horizontal direction (movement direction of the carriage 41) and 18 dots in the paper plane vertical direction (carrying direction of the mediums), amounting to a total of 504 dots. In the present embodiment, large-sized ink droplets are ejected from each nozzle #1 to #180 of the color-ink nozzle rows 211, and each dot is formed as a large-sized dot (large dot).

===Clear-ink Test Pattern===

Moreover, in this embodiment, test patterns 420 that can be used to inspect ejection from the nozzles #1 to #180 of the clear-ink nozzle row are formed in some of the block-shaped test patterns making up the test-pattern group 414 for each nozzle, by firing clear ink in an overlapping manner from the clear-ink nozzle row 212.

Figure 15:
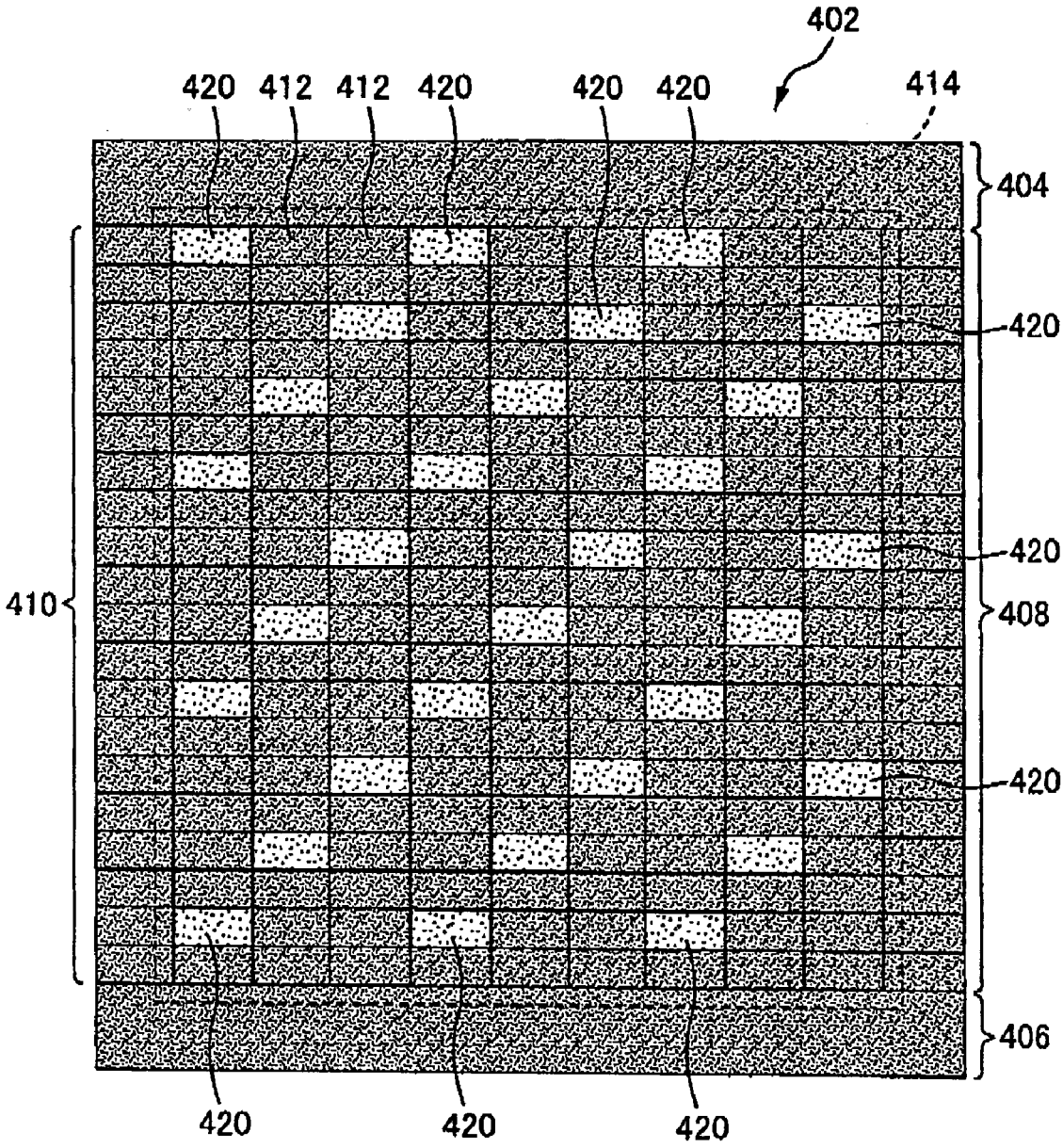
FIG. 15 is a diagram for describing the clear-ink test patterns.

FIG. 15 shows how the test patterns 420 are formed in the test-pattern group 414 for each nozzle. As shown in this diagram, the test patterns 420 are provided in such a manner that clear ink patterns, which have substantially the same size as the clear-ink test patterns 412, are formed on and overlap the color-ink ejection test patterns 412. A plurality of the test patterns 420 are disposed dispersed in the test-pattern group 414 for each nozzle with a suitable spacing between one another. Here, not taking into account the upper, lower, right, and left test margins 404, 406, 408, and 410, the clear-ink test patterns 420 are formed at a ratio of one per six color-ink test patterns 412.

<Reason for Overlapping with the Color Ink>

As shown in the drawing, by introducing clear ink in an overlapping manner to form the test patterns 420, the test patterns 420 become lighter in color than sections to which only color ink adheres, making them easily discerned from other sections. As a result, by evaluating the color darkness, it is possible to easily check whether or not clear ink is being ejected properly.

The following is a conceivable reason for why the color becomes lighter when clear ink and color ink are overlapping. It is likely that when both clear ink and color ink adhere to the same region, there is a higher degree of permeation into the medium S than when only color ink adheres thereto, increasing the amount of permeation into the mediums. In other words, it is conceivable that, because the amount of ink is increased by an amount of introduced clear ink, the ink deeply permeates and soaks into the medium S, and therefore the amount of ink remaining on the surface of the medium S decreases, resulting in a lighter color darkness.

Figure 16A:
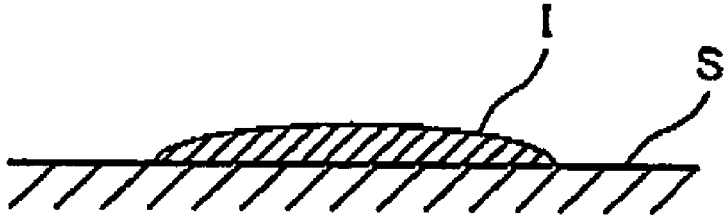
FIG. 16A is a diagram showing the appearance when only color ink is adhering.
Figure 16B:
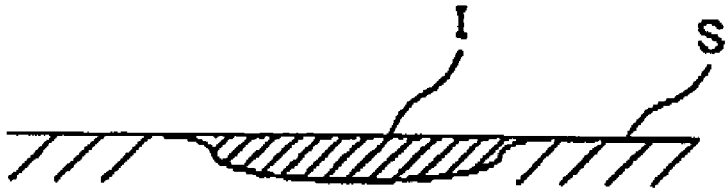
FIG. 16B is a diagram showing the appearance when both clear ink and color ink are adhering.

FIG. 16A is a diagram showing the appearance when only color ink has adhered, and FIG. 16B is a diagram showing the appearance when both clear ink and color ink adhere. As shown in FIG. 16A, when only the color ink adheres, the ink I does not significantly permeate into the medium S and much of it remains on the surface of the medium S, and thus the color appears relatively dark. On the other hand, when both clear ink and color ink adhere to the medium S, then, as shown in FIG. 16B, the permeability of the ink I, in which the clear ink and the color ink are mixed, is increased, causing most of the ink I to permeate into the medium S, leaving hardly any ink remaining on the surface of the medium S. Because hardly any of the ink I remains on the surface of the medium S, it is believed that this causes the color to become lighter and thinner than when only color ink adheres to the medium S.

It should be noted that the color inks that noticeably become light when clear ink has been introduced thereto are the color inks that are relatively dark in color, that is, in the present embodiment, magenta (M), cyan (C), black (Bk), light magenta (LM), light cyan (LC), and dark yellow (DY). Relatively light-colored color inks such as yellow (Y) do exhibit some change in color but this change in color is not significant, and it is difficult for various types of sensors, such as the aforementioned reflective optical sensor 300, to accurately detect this change in color. Therefore, when forming the clear-ink test patterns 420, it is preferable to use color inks that are relatively dark in color, that is, in the present embodiment, the color inks other than yellow (Y), i.e., magenta (M), cyan (C), black (Bk), light magenta (LM), light cyan (LC), and dark yellow (DY). Other examples of color inks that are relatively dark in color include the color inks of green (G), violet (V), red (R), and blue (B).

Each pattern 420 for inspecting clear ink, like the patterns 412 for inspecting the color inks, is associated with a single nozzle as shown in FIG. 15. That is, each test pattern 420 is formed by only clear ink that has been ejected from one of the different nozzles, and is associated with one of the nozzles #1 to #180 of the clear-ink nozzle row 212. In the present embodiment, as shown in FIG. 14, in a single test pattern 420, the clear ink is ejected as 28 dots in the paper plane horizontal direction (movement direction of the carriage 41) and 18 dots in the paper plane vertical direction (carrying direction of the medium S), amounting to a total of 504 dots, like the patterns 412 for inspecting color ink.

<Amount of Clear Ink that is Introduced>

The amount of ink per dot that is introduced, however, is smaller than that of the color ink. This is so that it becomes possible for the sensor mounted in the printing apparatus, such as the reflective optical sensor 300, to accurately detect the change in color that results from introducing clear ink.

When too much clear ink is introduced, the change in color is so great that it is impossible to discern the color from the base color, such as white, and the color can no longer be accurately detected. On the other hand, when too little clear ink is introduced, the change in color is small and it is not easy to discern the color from a case in which only color ink adheres to the medium S. That is, it is preferable that the amount of clear ink introduced is set to a suitable amount that allows for accurate recognition by the sensor. In the present embodiment, whereas large ink droplets of color ink are ejected in order to form large dots, the clear ink is ejected as small ink droplets to form small dots.

It should be noted that in the present embodiment the amount of clear ink ejected is set less than the color ink so that the change in color that occurs is to a degree that allows for easy detection by the reflective optical sensor 300 etc., but the present invention is not limited to this, and as long as the change in color can be easily detected by the reflective optical sensor 300 etc., then it is also possible for the amount of clear ink that is ejected to be greater than or equal to that of the color ink.

<Range in which Clear-ink Test Patterns are Formed>

Figure 17:
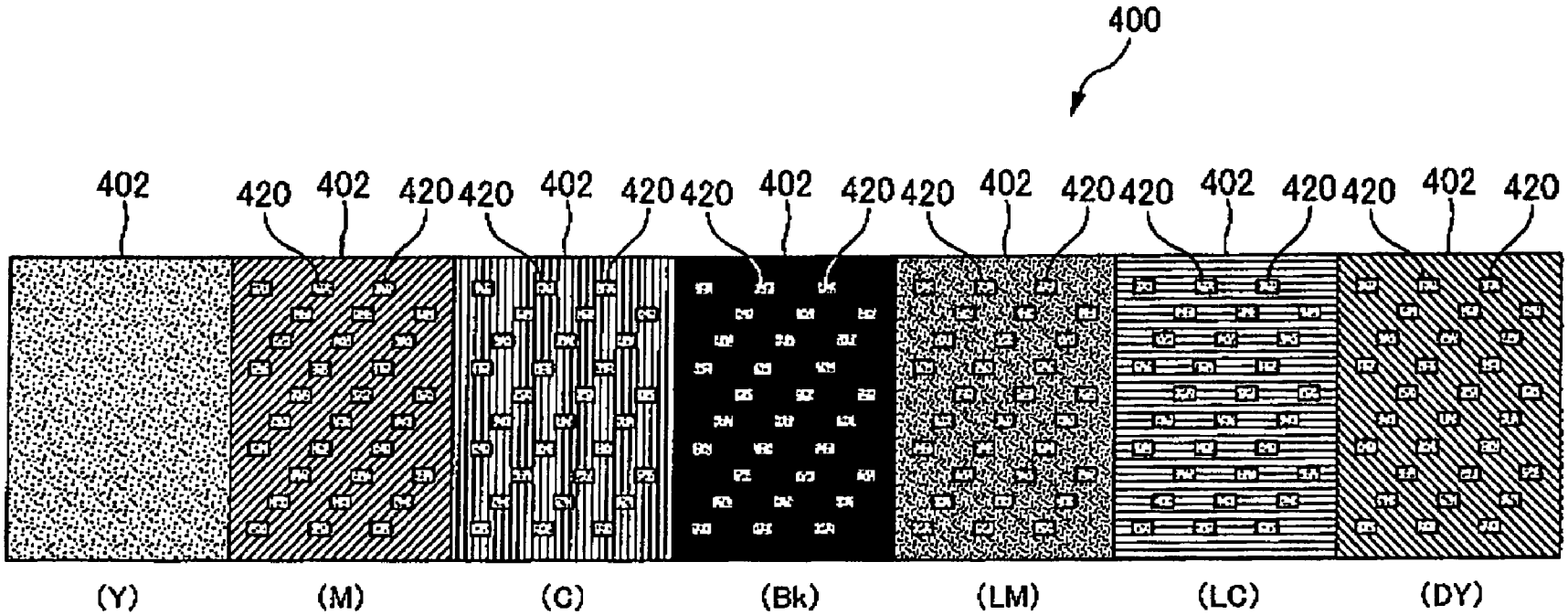
FIG. 17 is a diagram showing how the clear-ink test patterns are distributed.

In the present embodiment, the clear-ink test patterns 420 are also formed in color patterns 402 other than the pattern 402 shown in FIG. 15 (see FIG. 12 for details). FIG. 17 shows how the clear-ink test patterns 420 are formed in the other color patterns 402. As shown in this drawing, a plurality of the clear-ink test patterns 420 are formed dispersed in the other color patterns 402, with a suitable spacing between them, within the test-pattern group 414 for each nozzle in the same manner as in the pattern 402 shown in FIG. 15.

However, in the present embodiment, clear-ink test patterns 420 are not formed in the yellow (Y) pattern 402. This is because, as discussed earlier, it is difficult for the reflective optical sensor 300 etc. to accurately detect the change in color of yellow. Therefore, in the present embodiment, clear-ink test patterns 420 are formed in the patterns 402 of the ink colors other than yellow (Y), that is, the magenta (M), cyan (C), black (Bk), light magenta (LM), light cyan (LC), and dark yellow (DY) patterns 402.

In this manner, in the present embodiment, the clear-ink test patterns 420 are formed spread out over six color patterns 402, and thus the clear ink patterns 420 are formed at a ratio of one per six color-ink test patterns 412 in the test-pattern groups 414 for each nozzle of the color patterns 402.

It should be noted that in the present embodiment, yellow (Y) is not used as a color ink that is overlapped by clear ink because it is relatively light in color, but it is also possible for other color inks to serve as the color ink that is not overlapped by clear ink.

Also, in the present embodiment, there is only one color that is not overlapped by clear ink, but the present invention is not limited to this, and it is also possible for two or more colors to not be overlapped by clear ink.

<Reason why Space is Provided>

In the present embodiment, the clear-ink test patterns 420 are formed leaving a suitable space between them, as shown in FIG. 15 and FIG. 17. The reason for this is described in detail below. If clear ink is introduced in an overlapping manner to color ink, then the region in which the clear ink has been introduced in an overlapping manner has an amount of ink that is greater, by the amount of clear ink that has been introduced in an overlapping manner, compared to regions in which clear ink is not overlappingly introduced and thus the effect of warping, for example, of the medium S is increased. When regions in which both clear ink and color ink are ejected are formed very closely, then the impact of warping etc. on the medium becomes large, and there is a possibility that this may very negatively affect detection by various types of sensors, such as the reflective optical sensor 300.

Figure 18A:
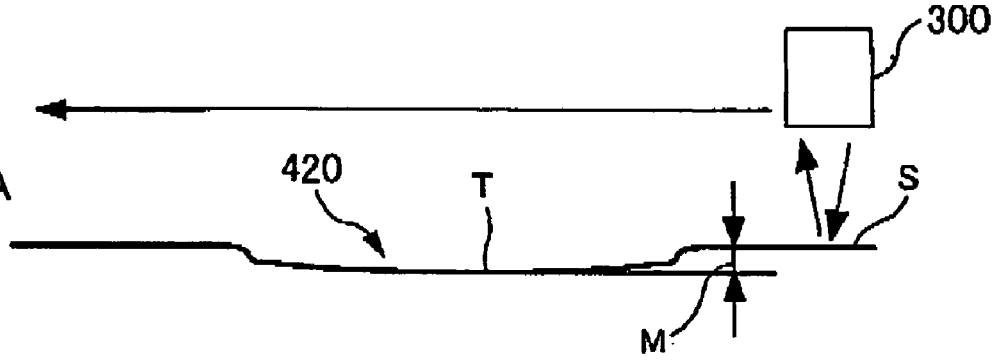
FIG. 18A is a diagram illustrating detection by the reflective optical sensor 300 when regions in which clear ink and color ink have been ejected overlapping one another are formed very closely.
Figure 18B:
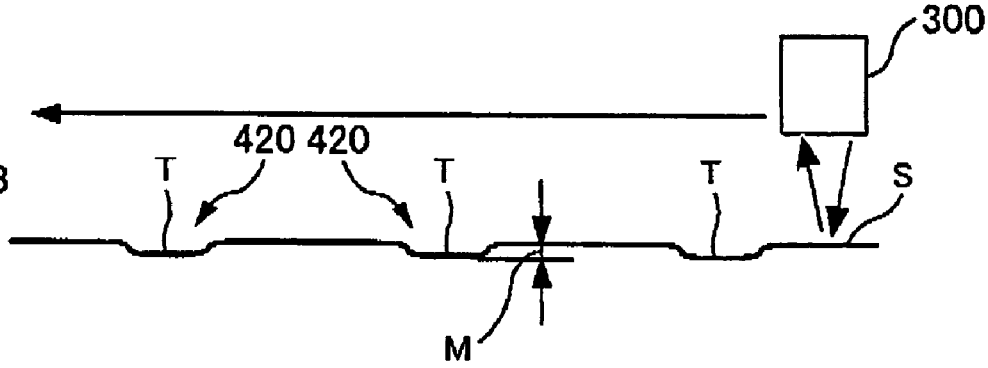
FIG. 18B is a diagram illustrating detection by the reflective optical sensor 300 when regions in which clear ink and color ink have been ejected overlapping one another are formed dispersed.

FIG. 18A is a diagram describing detection by the reflective optical sensor 300 when regions in which clear ink and color ink are ejected overlapping one another are formed very closely, and FIG. 18B is a diagram describing detection by the reflective optical sensor 300 when regions in which clear ink and color ink are ejected overlapping one another are formed dispersed. As shown in FIG. 18A, if the regions in which clear ink and color ink have been ejected overlapping one another are formed very densely, then a large depression T of a warp amount M, for example, occurs on the medium S, and when the reflective optical sensor passes over this depression T, the distance between the reflective optical sensor 300 and the medium S changes by the warp amount M. This can have a large impact on the reflected light that is detected by the reflective optical sensor 300. On the other hand, if the regions in which clear ink and color ink overlap are formed dispersed, then, as shown in FIG. 18B, the depressions T that are formed in the medium S are each small and the warp amounts M thereof also are small, and thus there is little fluctuation in the distance between the reflective optical sensor 300 and the medium S, and therefore, the effect on the reflected light that is detected by the reflective optical sensor 300 is not very large. That is, the pattern 300 for inspecting clear ink and color ink can be detected smoothly by the reflective optical sensor 300.

===Method for Checking Test Patterns===

The following is a description of the method for checking the test patterns formed in this manner. The test patterns are checked using the reflective optical sensor 300 provided in the carriage 41. The reflective optical sensor 300 is disposed above the test patterns and moves relative to the medium s due to movement by the carriage 41, checking the block-shaped patterns formed in the test patterns row by row. At this time, light is emitted toward the medium S from the light-emitting section 300A of the reflective optical sensor 300, and the emitted light is reflected by the medium S and received by the light-receiving section 300B. The reflective optical sensor 300 outputs the amount of light received by the light-receiving portion 300B to the system controller 126.

The system controller 126 checks the nozzles individually row by row for whether or not there is ejection failure based on the results of the light received from the reflective optical sensor 300. Specifically, the system controller 126 compares the output value from the light-receiving section 300B of the reflective optical sensor 300 with a predetermined threshold value that has been stored in the main memory, for example, to determine whether or not there is ejection failure.

Figure 19A:
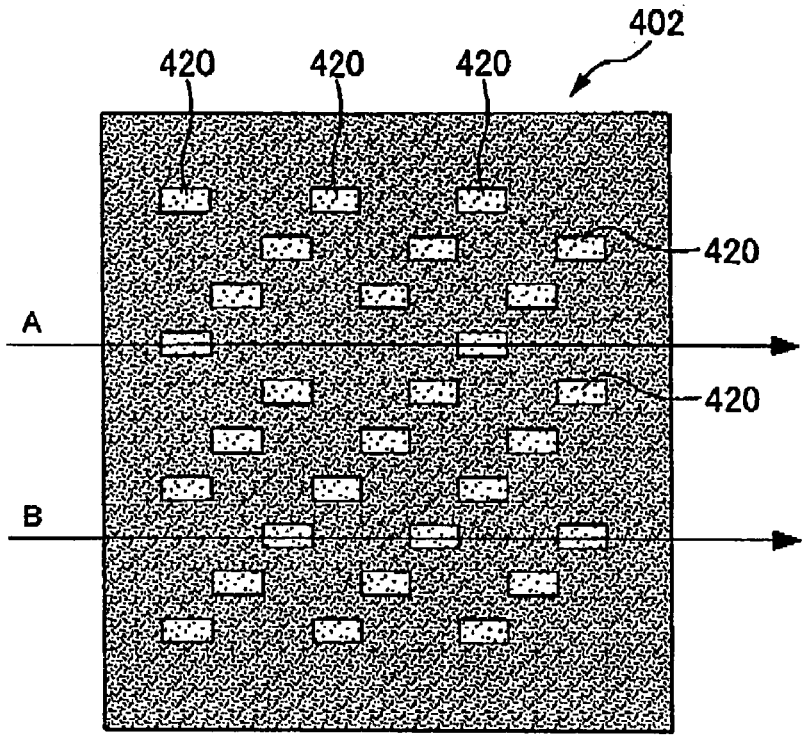
FIG. 19A is a diagram showing the test patterns that are to be detected.
Figure 19B:
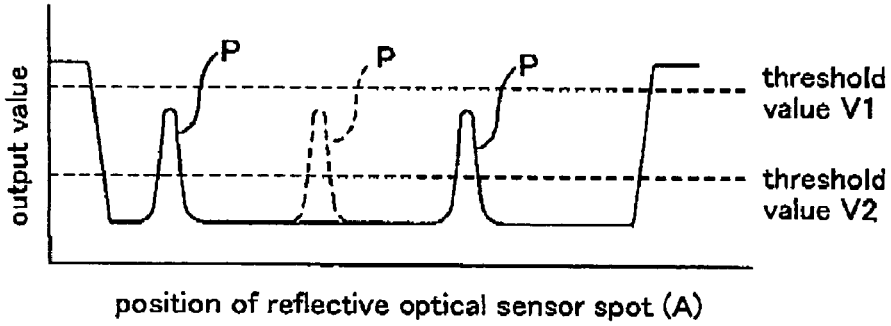
FIG. 19B is a diagram showing the output values of the reflective optical sensor 300 when that sensor 300 is moved along the arrow A in FIG. 19A.
Figure 19C:
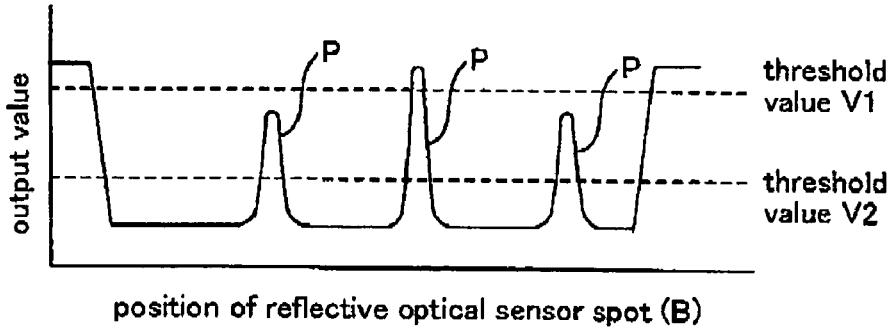
FIG. 19C is a diagram showing the output values of the reflective optical sensor 300 when that sensor 300 is moved along the arrow B in FIG. 19A.

FIG. 19A shows the test patterns to be detected, FIG. 19B shows the output values of the reflective optical sensor 300 when the sensor 300 has been moved along the arrow A in FIG. 19A, and FIG. 19C shows the output values of the reflective optical sensor 300 when the sensor 300 has been moved along the arrow B in FIG. 19A. It should be noted that the reflective optical sensor 300 outputs a higher voltage the greater the amount of light that is received, and outputs a lower voltage the smaller the amount of light that is received. In other words, when color ink adheres to the medium S, there is a reduced amount of reflected light and the output voltage of the reflective optical sensor 300 also becomes low.

Here, when the reflective optical sensor 300 moves along the arrow A and comes across a test pattern 402, then, as shown in FIG. 19B, the output value of the reflective optical sensor 300 drops significantly. Then, when the reflective optical sensor 300 arrives at a clear-ink test pattern 420, the amount of light that is received by the reflective optical sensor 300 is temporarily increased because the color darkness here is lighter than that of regions in which only color ink adheres, generating a peak P. Whether or not this peak P exceeds a predetermined threshold value, that is, the threshold value V2 in this example, is used to check whether or not clear ink has been ejected properly. That is, if clear ink has been ejected properly, then the peak P will exceed the threshold value V2 at a predetermined point where the clear-ink test pattern should have been formed, and thus it can be confirmed that the clear ink has been properly ejected. On the other hand, if the clear ink has not been properly ejected, then a pattern made only of color ink is formed on the medium S, and thus a peak P that exceeds the threshold value V2, such as that shown by the broken line in the diagram, does not appear.

It should be noted that in the present embodiment, each clear-ink test pattern 420 is formed by color ink that has been ejected from a single nozzle, and thus if there is an ejection failure such as clogging in the nozzle for the color ink that forms that clear-ink test pattern, then color ink is not ejected and there is no color ink. In this case, even if only the clear ink is ejected normally, it is very difficult for the reflective optical sensor 300 to detect this clear ink. Accordingly, in the present embodiment, in a case where only clear ink has been ejected, the color becomes the base color of the medium S, that is, white, causing the height of the peak P to become even higher, as shown in FIG. 19C. Therefore, whether or not the color ink has been ejected normally is checked based on whether or not the peak P exceeds a predetermined threshold value (here, the threshold value V1). That is, when the peak P does not exceed the threshold value V1, it is determined that the color ink has been ejected normally, whereas when the peak P does exceed the threshold value V1, it is determined that the color ink has not been ejected normally. Thus, it is possible to check whether or not there is ejection failure for the color-ink nozzles as well.

Figures 20, 21:
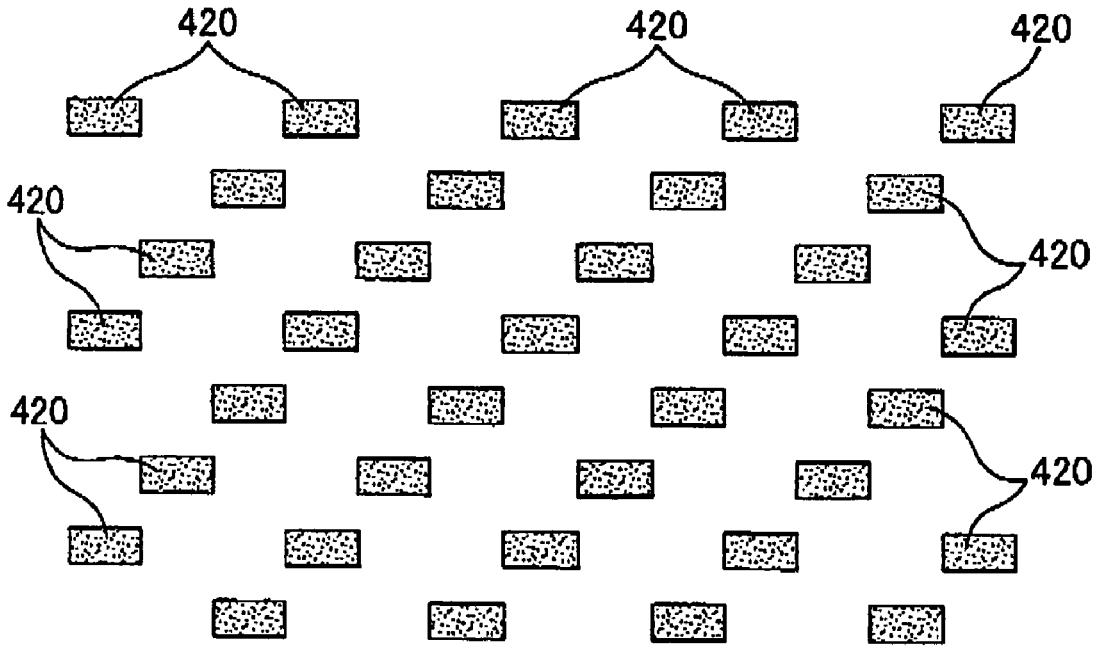
FIG. 20 is a chart showing the setting information of the threshold values for each color.
FIG. 21 is a diagram showing another embodiment of the clear-ink test patterns.

It should be noted that in the present embodiment, the threshold value V1 and the threshold value V2 are each independently set in accordance with the color of the color ink. FIG. 20 is a table compiling the setting values of the threshold value V1 and the threshold value V2 by color. The threshold value V1 and the threshold value V2 are set individually for each color ink that is overlapped by clear ink, that is, in the present embodiment, cyan (C), magenta (M), black (Bk), light cyan (LC), light magenta (LM), and dark yellow (DY), to the respective threshold values V1C, V2C, V1M, V2M, V1Bk, V2Bk, V1LC, V2LC, V1LM, V2LM, V1DY, and V2DY. These threshold values are stored in advance in a suitable storage section such as the main memory 127.

When one row has been checked, the medium S is carried by the carrying section and the checking to be performed next is performed. In this manner, the test pattern 400 is successively checked for whether or not there is ejection failure. It should be noted that if an ejection failure is found at even one location during checking, then it is possible to end checking immediately and perform nozzle cleaning. Also note that the system controller 126 corresponds to the checking means in the present invention.

===Action Taken when Ejection Failure is Discovered===

If the result of the ejection inspection described above is that the sensor discovers nozzles having ejection failure such as clogging, then a cleaning operation for eliminating the ejection failure, such as clogging, is performed. The cleaning operation that can be executed here includes the following. It should be noted that in the present embodiment, the various color-ink nozzle rows 211 and the clear-ink nozzle row 212 are cleaned together, and thus cleaning is carried out if an ejection failure has occurred in a nozzle of either nozzle row, regardless of whether that row is a color-ink nozzle row or a clear-ink nozzle row.

<Nozzle Suction>

This method is carried out using the cleaning device described in FIG. 2. More specifically, ink is forcibly sucked out from the nozzles by the above-mentioned pump device 31 to eliminate any ejection failure such as clogging.

<Flushing>

Flushing is a method by which ink is forcefully ejected from the nozzles. More specifically, the piezo elements of the nozzles are driven to forcibly discharge ink from the nozzles. This eliminates ejection failure such as clogging.

===Action and Effects===

According the foregoing embodiment, overlapping clear ink and color ink causes the color of the color ink to change and lightens the color darkness, making it possible to easily confirm whether or not the clear ink has been ejected properly. Further, the regions in which the clear ink and the color ink overlap one another are formed leaving a spacing between them, so that warping of the medium can be inhibited as much as possible, and as a result, the detection precision of the sensor, such as the reflective optical sensor, is increased, allowing the test patterns to be detected with ease.

Also, by not overlapping the clear ink onto color inks that are light in color such as yellow, which changes little in color even when overlapped by clear ink, it is possible to reliably inspect ejection failure in the clear ink.

Further, due to each clear-ink test pattern 420 being formed by color ink that has been ejected from a single color-ink nozzle, it is possible to perform inspection of ejection for clear ink and color inks using the same pattern.

Also, because the color-ink test patterns 412 are formed between the clear-ink test patterns 420, it is possible to reduce needless consumption of the medium and to simultaneously inspect the clear ink and the color inks.

===Other Embodiments===

In the foregoing embodiment, the clear-ink test patterns 420 are formed integrated into the color-ink test patterns, but the present invention is not limited to this, and it is also possible for only the clear-ink test patterns to be formed independently and separate from the color-ink test patterns. FIG. 21 is a diagram showing an example of a case where only clear-ink test patterns are formed independently from the color-ink test patterns. As shown in this drawing, as long as the clear-ink test patterns 420 are formed leaving a space between one another, it is also possible for the only clear-ink test patterns to be formed independently.

Figure 22:
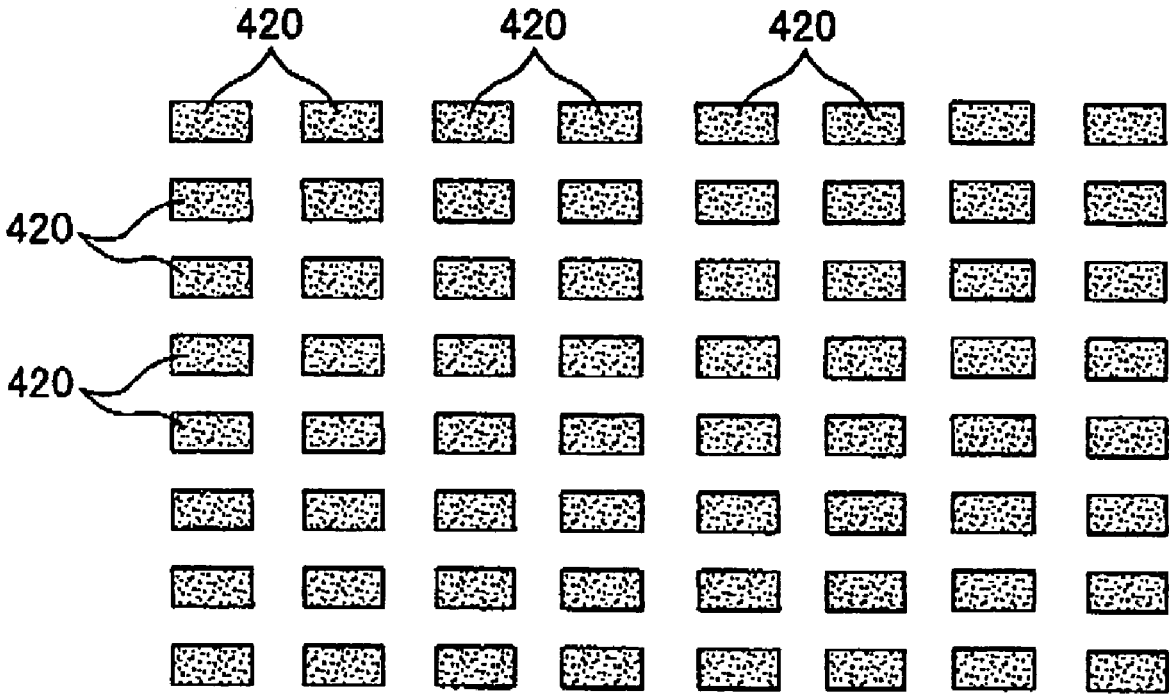
FIG. 22 is a diagram showing another embodiment of the clear-ink test patterns.

Also, in the foregoing embodiment, the clear-ink test patterns 420 are disposed in a pattern such as that shown in FIG. 15 so that they are formed integrated into the color-ink test patterns, but the present invention is not limited to this, and as long as the clear-ink test patterns 420 are formed in a manner that leaves a space between one another, then it is also possible for the clear-ink test patterns 420 to be disposed according to other patterns as well. FIG. 22 is a diagram showing an example of a case in which the clear-ink test patterns 420 are formed disposed according to another pattern. As shown in FIG. 22, the clear-ink test patterns 420 are formed in eight rows in the horizontal direction and eight rows in the vertical direction with a suitable spacing between them. It is also possible to form the clear-ink test patterns 420 in such a pattern.

===Modified Examples and Applied Examples===

The following is a description of an example of a printing system provided with an inkjet printer, which serves as a printing apparatus, as an example of a printing system according to the present invention.

Figure 23:
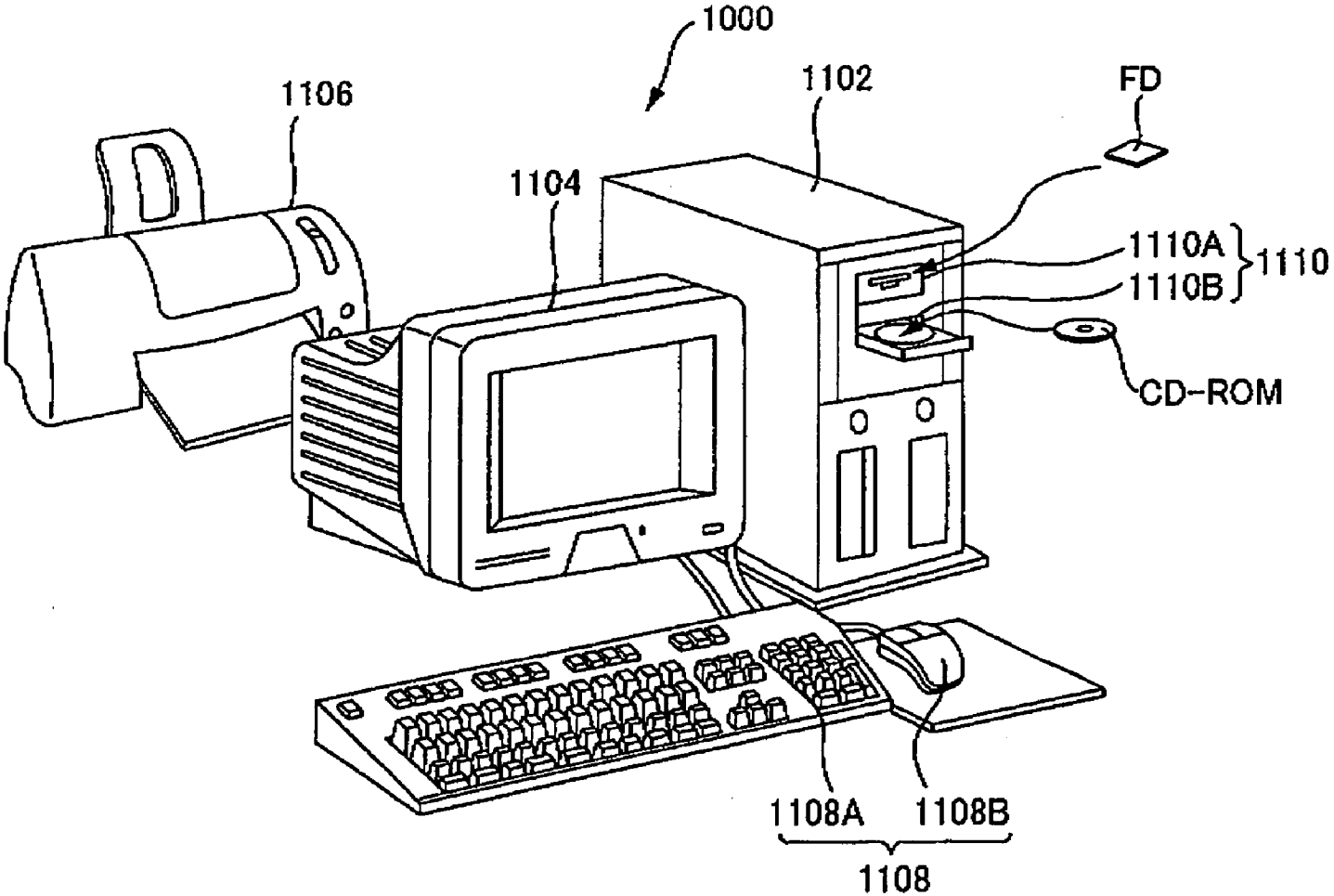
FIG. 23 is a diagram showing the external configuration of a printing system.

FIG. 23 is an explanatory diagram showing the external configuration of the printing system. A printing system 1000 is provided with a main computer unit (which may also be referred to as a "computer") 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 24:
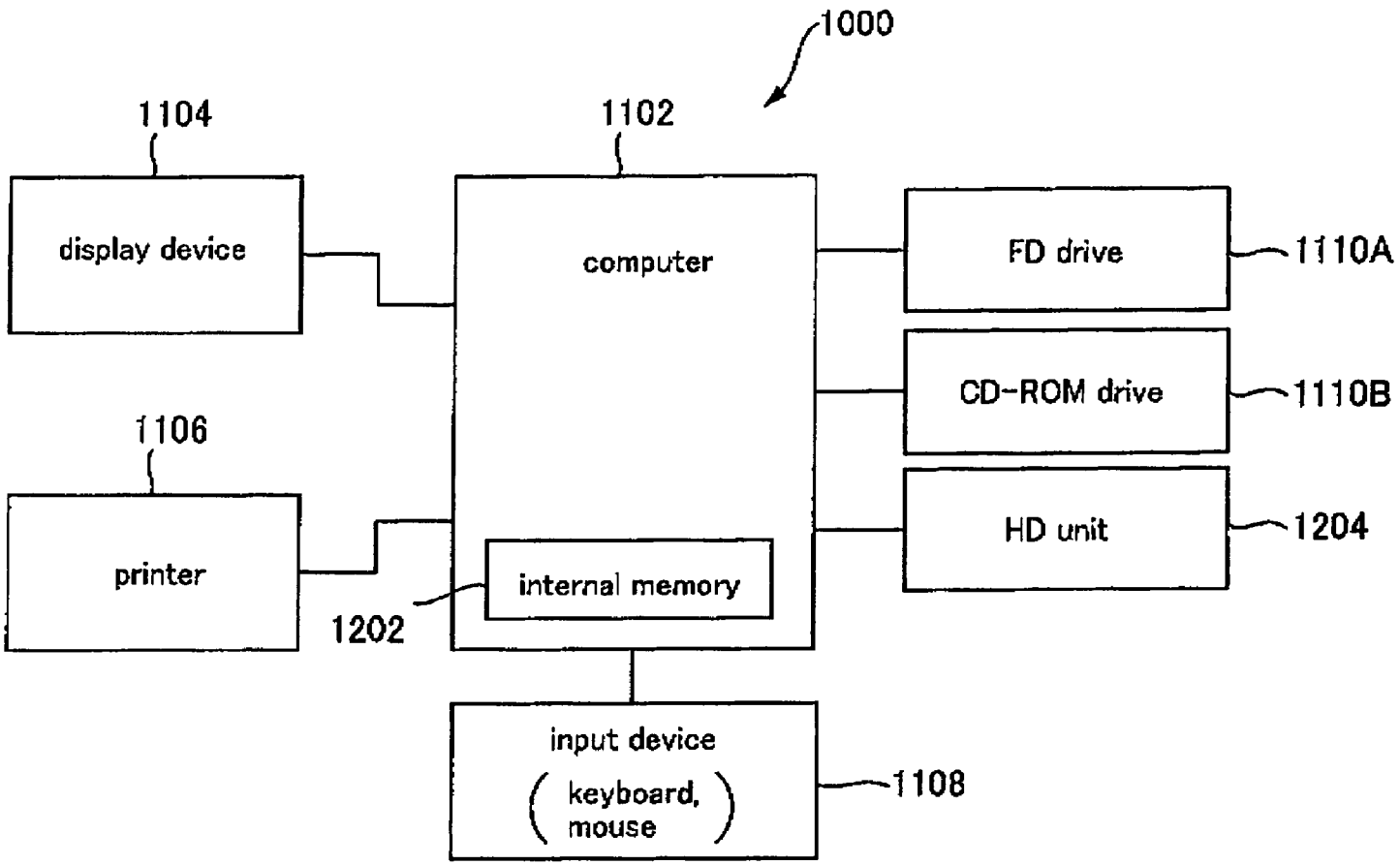
FIG. 24 is a block diagram showing the configuration of the printing system.

FIG. 24 is a block diagram showing the configuration of the printing system shown in FIG. 23. An internal memory 1202 such as a RAM within the housing accommodating the main computer unit 1102 and, also, an external memory such as a hard disk drive unit 1204 are provided.

A computer program for controlling the operation of the above printer can be downloaded onto the computer 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMS, magneto optical disks MOs, hard disks, and memories. It should be noted that information stored on such storage media can be read by various types of reading devices 1110.

In the above description, an example was described in which the computer system is constituted by connecting the printer 1106 to the main computer unit 1102, the display device 1104, the input device 1108, and the reading device 1110. However, this is not a limitation. For example, the computer system can be made of the main computer unit 1102 and the printer 1106, or the computer system does not have to be provided with one of the display device 1104, the input device 1108, and the reading device 1110. It is also possible for the printer 1106, for example, to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As an overall system, the printing system that is thus achieved becomes superior to conventional systems.

===Other Embodiments===

In the foregoing, a printing apparatus such as a printer according to the invention was described based on an embodiment thereof. However, the foregoing embodiment is for the purpose of elucidating the present invention and is not to be interpreted as limiting the present invention. The invention can of course be altered and improved without departing from the gist thereof and includes its equivalents. In particular, the embodiments mentioned below are also included in the printing apparatus according to the present invention.

Furthermore, in the present embodiment, all or part of the configuration realized by hardware may be replaced by software. Conversely, parts of the configuration realized by software may be replaced by hardware.

Furthermore, in addition to printing paper, the medium to be printed may be cloth or film, for example.

Furthermore, part of the processes carried out on the printing apparatus side may be carried out on the host side, and it is also possible to interpose a special-purpose processing device between the printing apparatus and the host such that some of the processes are carried out by the processing device.

<Regarding the Printing Apparatus>

The printing apparatus according to the present invention is not limited to the above-described inkjet printer, and may be a printing apparatus that carries out printing using a different method of ink ejection, such as a bubble-jet (registered trademark) type printer.

<Regarding the Color-ink Nozzle>

In the foregoing embodiment, a nozzle row in which a multitude of nozzles are arranged in a straight line as described above was given as an example of the color-ink nozzle, but the present invention is not limited to such a nozzle row, and the color-ink nozzle may be arranged in any form as long as it is a nozzle that ejects color ink.

<Regarding the Clear-Ink Nozzle>

In the foregoing embodiment, a nozzle row in which a multitude of nozzles are arranged in a straight line as described above was given as an example of the clear-ink nozzle, but the present invention is not limited to such a nozzle row, and the clear-ink nozzle may be arranged in any form as long as it is a nozzle that ejects clear ink.

<Color Inks>

In the foregoing embodiment, the color inks that are used are the color inks yellow (Y), cyan (C), magenta (M), black (Bk), light cyan (LC), light magenta (LM), and dark yellow (DY), but the present invention is not limited to this, and it is also possible for other color inks such as green (G), violet (V), red (R), and blue (B) to be added, and the combination of the color inks that are used can be different. In this case, it is possible to use a color ink other than yellow (Y) as the color ink that is not to be overlapped by clear ink. It is also possible for color inks other than cyan (C), magenta (M), black (Bk), light cyan (LC), light magenta (LM), and dark yellow (DY) to be set as the color ink that is to be overlapped by the clear ink.

<Test Patterns>

In the foregoing embodiment, patterns such as those shown in FIGS. 12 to 15 and FIG. 17 are used, but the present invention is not limited to these, and other pattern types can also be used.

<Regarding the Medium S>

Regarding the medium S, it is possible to use plain paper, matte paper, cut paper, glossy paper, roll paper, print paper, photo paper, and roll-type photo paper or the like as the above-described print paper, and in addition to these, the medium may be a film material such as OHP film and glossy film, a cloth material, or a metal plate material or the like. In other words, it may be any kind of media as long as it is capable of being an object for the ejection of a liquid.

<Regarding the Sensor>

In the foregoing embodiment, a reflective optical sensor 300 was provided as a sensor for detecting the test pattern, but the present invention is not limited to this, and various types of sensors employing other systems, such as optical sensors of the type other than the reflective type, may be provided as long as they are able to detect the test pattern.

Further, in the foregoing embodiment, the sensor 300 (reflective optical sensor) was provided on the carriage 41, but the present invention is not limited to this, and the sensor may be provided in/on places other than the carriage 41.

<Detecting Method>

In the foregoing embodiment, the test patterns of both the clear ink and the color ink were detected using the sensor 300 (reflective optical sensor) installed in the printing apparatus and inspection was automatically performed by the printing apparatus, but the present invention is not limited to this, and the test patterns may be checked using other inspection devices etc., or they may be checked by a person.

What is claimed is:

1. A method for detecting ejection of a plurality of clear-ink nozzles, comprising the steps of:

causing a color ink to adhere to a medium;

ejecting a clear ink toward said medium from each of said clear-ink nozzles;

forming on said medium test patterns that each corresponds to one of said clear-ink nozzles using said clear ink ejected from each of said clear-ink nozzles and said color ink, while leaving a space between said test patterns; and inspecting ejection of each of said clear-ink nozzles based on said test patterns formed corresponding to the respective clear-ink nozzles, wherein each of said test patterns include dots of said clear ink that are formed in a movement direction of a carriage and dots of said clear ink that are formed in a carrying direction of said medium.

2. A method for detecting ejection according to claim 1, wherein the color ink is ejected from a plurality of color-inknozzles in order to cause the color ink to adhere to said medium;

wherein specific color-ink nozzles, of among said plurality of color-ink nozzles, respectively correspond to said test patterns; and wherein ejection of each of those color-ink nozzles corresponding to said test patterns is inspected using the respective test patterns.

3. A method for detecting ejection according to claim 2, wherein patterns that are used to inspect ejection of color-ink nozzles, of among said plurality of color-ink nozzles, that are not made to correspond to said test patterns are formed between said test patterns.

4. A method for detecting ejection according to claim 1, wherein color inks of different colors are ejected from a plurality of types of color-ink nozzles in order to cause the color inks of different colors to adhere to said medium; and wherein each said test pattern is formed, for each said clear-ink nozzle, on said medium using the clear ink that is ejected from that clear-ink nozzle and a color ink of one of the different colors.

5. A method for detecting ejection according to claim 1, wherein color inks of different colors are ejected from a plurality of types of color-ink nozzles in order to cause the color inks of different colors to adhere to said medium; and wherein said test patterns are formed on said medium using a color ink other than the color ink that is lightest in color.

6. A method for detecting ejection according to claim 1, wherein a darkness of the color when the clear ink and the color ink adhere to a same region is different from a darkness of the color when that color ink adheres to a region to which the clear ink has not adhered.

7. A method for detecting ejection according to claim 6, wherein a darkness of the color when the clear ink and the color ink adhere to the same region is lighter than a darkness of the color when that color ink adheres to the region to which the clear ink has not adhered.

8. A method for detecting ejection according to claim 1, wherein each of said test patterns is formed in a block shape.

9. A method for detecting ejection according to claim 1, wherein the color ink is ejected from a plurality of color-ink nozzles in order to cause the color ink to adhere to said medium; and wherein an amount of the clear ink ejected from said clear-ink nozzles in order to form said test patterns is different from an amount of the color ink ejected from said color-ink nozzles.

10. A method for detecting ejection according to claim 9, wherein the amount of the clear ink ejected from said clear-ink nozzles is less than the amount of the color ink ejected from said color-ink nozzles.

11. A method for detecting ejection according to claim 1, wherein whether or not there is ejection failure in said clear-ink nozzles is checked based on detection information from a sensor for detecting said test patterns that are formed on said medium.

12. A method for detecting ejection of a plurality of clear-ink nozzles, comprising the steps of:

causing a color ink to adhere to a medium;

ejecting a clear ink toward said medium from each of said clear-ink nozzles;

forming, on said medium, test patterns that each corresponds to one of said clear-ink nozzles using said clear ink ejected from each of said clear-ink nozzles and said color ink, while leaving a space between said test patterns; and inspecting ejection of each of said clear-ink nozzles based on said test patterns formed corresponding to the respective clear-ink nozzles;

wherein:

color inks of different colors are ejected from a plurality of color-ink nozzles of a plurality of types, in order to cause the color inks of different colors to adhere to said medium;

specific color-ink nozzles, of among said plurality of color-ink nozzles, respectively correspond to said test patterns;

ejection of each of those color-ink nozzles corresponding to said test patterns is inspected using the respective test patterns;

patterns that are used to inspect ejection of color-ink nozzles, of among said plurality of color-ink nozzles, tat are not made to correspond to said test patterns are formed between said test patterns;

each said test pattern is formed, for each said clear-ink nozzle, on said medium using the clear ink that is ejected from that clear-ink nozzle and a color ink of one of the different colors;

said test patterns are formed on said medium using a color ink other than the color ink that is lightest in color;

a darkness of the color when the clear ink and the color ink adhere to the same region is lighter than a darkness of the color when that color ink adheres to a region to which the clear ink has not adhered;

each of said test patterns is formed in a block shape;

an amount of the clear ink ejected from said clear-ink nozzles in order to form said test patterns is less than an amount of the color ink ejected from said color-ink nozzles;

whether or not there is ejection failure in said clear-ink nozzles is checked based on detection information from a sensor for detecting said test patterns that are formed on said medium, and each of said test patterns include dots of said clear ink tat are formed in a movement direction of a carriage and dots of said clear ink tat are formed in a carrying direction of said medium.

13. A printing apparatus comprising:

a color-ink nozzle for ejecting a color ink;

a plurality of clear-ink nozzles for ejecting a clear ink; and a controller for controlling the ejection of ink from said color-ink nozzle and said clear-ink nozzles;

wherein:

said controller controls the ejection of the color ink from said color-ink nozzle and the ejection of the clear ink from said clear-ink nozzles, to form, on a medium, test patterns that each corresponds to one of said clear-ink nozzles and that each includes said clear ink ejected from each of said clear-ink nozzles and said color ink, while leaving a space between said test patterns, and each of said test patterns include dots of said clear ink that are formed in a movement direction of a carriage and dots of said clear ink tat are formed in a carrying direction of said medium.

14. A method for forming patterns for detecting ejection of a plurality of clear-ink nozzles, comprising the steps of:

causing a color ink to adhere to a medium;

ejecting a clear ink toward said medium from each of said clear-ink nozzles; and forming, on said medium, test patterns that each corresponds to one of said clear-ink nozzles using said clear ink ejected from each of said clear-ink nozzles and said color ink, while leaving a space between said test patterns, wherein each of said test patterns include dots of said clear ink that are formed in a movement direction of a carriage and dots of said clear ink that are formed in a carrying direction of said medium.

15. A computer-readable storage medium storing a control program to have a computer carry out a pattern forming method for detecting ejection of a plurality of clear-ink nozzles, the method comprising:

causing a color ink to adhere to a medium;

causing a clear ink to be ejected toward said medium from each of the plurality of clear-ink nozzles; and causing test patterns that each corresponds to one of said clear-ink nozzles to be formed on said medium using said clear ink ejected from each of said clear-ink nozzles and said color ink, while leaving a space between said test patterns, wherein each of said test patterns include dots of said clear ink that are formed in a movement direction of a carriage and dots of said clear ink that are formed in a carrying direction of said medium.

16. A printing system comprising:

a computer; and a printing apparatus that is connectable to said computer, said printing apparatus including:

a color-ink nozzle for ejecting a color ink;

a plurality of clear-ink nozzles for ejecting a clear ink; and a controller for controlling the ejection of ink from said color-ink nozzle and said clear-ink nozzles;

wherein:

said controller controls the ejection of the color ink from said color-ink nozzle and the ejection of the clear ink from said clear-ink nozzles, to form, on a medium, test patterns that each corresponds to one of said cleat-ink nozzles and that each includes said clear ink ejected from each of said clear-ink nozzles and said color ink, while leaving a space between said test patterns, and each of said test patterns include dots of said clear ink that are formed in a movement direction of a carriage and dots of said clear ink that are formed in a carrying direction of said medium.

* * * * *